US007135275B2

(12) United States Patent
Yoshida

(10) Patent No.: US 7,135,275 B2
(45) Date of Patent: Nov. 14, 2006

(54) SOLID BLEACH-FIXING COMPOSITION FOR SILVER HALIDE COLOR PHOTOGRAPHIC LIGHT-SENSITIVE MATERIAL, AND METHOD FOR PROCESSING SILVER HALIDE COLOR PHOTOGRAPHIC LIGHT-SENSITIVE MATERIAL

(75) Inventor: Kazuaki Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 8 days.

(21) Appl. No.: 10/920,275

(22) Filed: Aug. 18, 2004

(65) Prior Publication Data

US 2005/0053873 A1 Mar. 10, 2005

(30) Foreign Application Priority Data

Aug. 28, 2003 (JP) ..... P.2003-304849
Sep. 16, 2003 (JP) ..... P.2003-323035

(51) Int. Cl.
*G03C 7/42* (2006.01)

(52) U.S. Cl. ..... 430/458; 430/460

(58) Field of Classification Search ..... 430/458, 430/460

See application file for complete search history.

(56) References Cited

U.S. PATENT DOCUMENTS 4,816,384 A * 3/1989 Fruge et al. ..... 430/465
5,298,370 A * 3/1994 Kojima et al. ..... 430/393
5,401,621 A 3/1995 Kojima et al.
5,415,983 A 5/1995 Kojima et al.
5,795,703 A 8/1998 Ishikawa
5,968,715 A * 10/1999 Ueda et al. ..... 430/372
6,103,458 A 8/2000 Seki
2002/0192604 A1 12/2002 Ishikwa et al.

FOREIGN PATENT DOCUMENTS

JP 2-109042 A 4/1990
JP 4-143757 A 5/1992
JP 5-127322 A 5/1993
JP 5-188533 A 7/1993
JP 6-186686 A 7/1994

OTHER PUBLICATIONS

European Search Report dated Jan. 5, 2005.

* cited by examiner

*Primary Examiner*—Hoa Van Le
(74) *Attorney, Agent, or Firm*—Sughrue Mion, PLLC

(57) ABSTRACT

A solid bleach-fixing composition for a silver halide color photographic light-sensitive material, comprising at least one specific 5-membered heterocyclic azoliumthiolate compound, particularly, a solid bleach-fixing composition wherein the specific thiolate compound is a diazoliumthiolate compound substituted by a water-soluble group. A method for processing a silver halide color photographic light-sensitive material, comprising using a bleach-fixing solution containing a specific 5-membered heterocyclic azoliumthiolate compound, and regenerating at least 50 mass % of the used bleach-fixing solution as a bleach-fixing processing agent for replenishment; and a method for processing a silver halide color photographic light-sensitive material, comprising regenerating at least 30 mass % of the used processing solution further containing used rinsing solution as a bleach-fixing processing agent for replenishment.

4 Claims, No Drawings

SOLID BLEACH-FIXING COMPOSITION FOR SILVER HALIDE COLOR PHOTOGRAPHIC LIGHT-SENSITIVE MATERIAL, AND METHOD FOR PROCESSING SILVER HALIDE COLOR PHOTOGRAPHIC LIGHT-SENSITIVE MATERIAL

BACKGROUND OF THE INVENTION

1. Field of the Invention

The present invention relates to a method for processing a silver halide color photographic light-sensitive material, more specifically, the present invention relates to a processing method where a used bleach-fixing solution is regenerated and used to reduce the amount of waste solution and also reduce the running cost. The present invention relates to a processing composition for a silver halide color photographic light-sensitive material, more specifically, the present invention relates to a solid bleach-fixing composition for a silver halide color photographic light-sensitive material.

2. Description of the Related Art

In recent years, in order to provide quick services to general users and rationalize the collection/delivery transportation between a photo-shop and a processing laboratory, an automatic processor called a mini-lab is abruptly spreading, which is installed at the front of a photo-shop and performs the processing of a photographic light-sensitive material. Conventionally, a liquid concentrate has been supplied as the processing agent for mini-lab use, but this processing agent is a liquid and therefore, has problems such as regulation at the transportation, danger of the container breakage due to impact, inconvenience in handling at the processing laboratory and restriction in the storing space. In order to solve these problems, studies are being made on, for example, a granular processing agent in JP-A-2-109042, a tablet processing agent in JP-A-5-127322 and a processing method of directly adding a solid processing agent to a processing tank in JP-A-5-188533. According to these methods, since the processing agent is a solid, the size and weight of the processing agent can be greatly reduced as compared with a liquid-type processing agent and this is very advantageous in view of transportation and storage but at the same time, new problems are incurred, that is, when stored in aging, a solid bleach-fixing agent using a hygroscopic fixing agent deliquesces to impair the stability, whereas a solid processing agent using a non-hygroscopic fixing agent is solidified by undergoing consolidation with each other. Furthermore, it is revealed that insoluble matters are generated when the solid agent is dissolved.

JP-A-6-186686 discloses a technique of preventing deliquescence by incorporating a mesoion compound together with a thiosulfate fixing agent into the solid fixing agent for the processing of a black-and-white light sensitive material. However, the object of JP-A-6-186686 is only to prevent deliquescence of the solid fixing agent and the problems of consolidation or generation of insoluble matters encountered in using a solid bleach-fixing agent, which are to be solved in the present invention, are not referred to at all. Thus, those problems which are to be solved in the present invention cannot be overcome by the technique disclosed in this patent publication.

Heretofore, a solid bleach-fixing agent succeeded in simultaneously solving all of the problems of deliquescence, consolidation and generation of insoluble matters has not been found.

In a method for processing a silver halide color photographic light-sensitive material, the used processing solution is generally discarded as an overflow solution, but in the overflow solution, effective components are remaining and therefore, a large number of studies are being made on a so-called regeneration technique of adding lacking components consumed in the processing to enable reuse of the solution and again using it as a replenisher. The recycling as a replenisher by using the overflow solution can realize not only resource saving and cost reduction because of use of chemicals is a small amount as compared with the case of newly preparing a replenisher, but also great reduction of the environmental load value resulting from decrease in the amount of overflow solution discarded, and therefore, this method is preferred in view of environmental conservation.

However, the technique of regenerating the overflow solution cannot be easily developed. Particularly, the bleach-fixing solution is considered highly difficult to regenerate. More specifically, the bleach-fixing solution generally contains at least three functional chemicals, that is, an aminopolycarboxylic acid iron (III) complex as the bleaching agent, a thiosulfate as the fixing agent, and a sulfite as the preservative. The overflow solution of the bleach-fixing solution further contains silver ion and color developer components carried over from the previous bath and at the same time, contains a ferrous aminopolycarboxylate. The reuse of this solution is accompanied with desilvering retardation, leuconization (leuco dye reciprocity failure) of cyanine dye, or undesired staining (staining of white base) due to accumulation of halogen ion or silver ion, accumulation of ferrous aminopolycarboxylate, accumulation of developer components, or accumulation of sulfate generated resulting from oxidation of sulfite ion.

A method of reducing silver ion by electrolysis and recovering it is described in U.S. Pat. No. 4,014,764. Also in this case, the iron(III) complex is simultaneously reduced into an iron(II) complex or sulfite ion at the anode is oxidized into sulfate ion, as a result, desilvering failure or leuco dye reciprocity failure is readily generated and at the same time, the stability of the solution decreases.

Also, a technique of regenerating an overflow solution by reducing the equilibrium accumulated amount of silver ion through dilution or the like without positively removing silver is disclosed in JP-A-48-49437 and JP-A-50-145231. This is a simple and inexpensive method because the regeneration and reuse can be realized without using a special apparatus for silver recovery. However, in this method, desilvering retardation is caused due to accumulation of silver halide dissolved out from the light-sensitive material, particularly, silver bromide dissolved out in a large amount, and furthermore, undesired staining or browning is readily generated due to accumulation of developer components. Thus, this method has a problem in the stability of running performance.

SUMMARY OF THE INVENTION

Accordingly, a first object of the present invention is to provide a compact bleach-fixing agent easy to transport and handle. A second object of the present invention is to provide a solid bleach-fixing agent free from consolidation or deliquescence even when stored for a long period of time in a high-temperature high-humidity environment. A third object of the present invention is to provide a solid bleach-fixing agent prevented from generation of insoluble matters even when stored for a long period of time in a high-temperature high-humidity environment.

In addition, an object of the present invention is to solve those problems encountered in the method of using a bleach-fixing solution and increase the reuse ratio, specifically, to provide a method for processing a silver halide photographic light-sensitive material, where the amount of waste solution is decreased by reusing the used bleach-fixing solution or the used bleach-fixing solution and rinsing solution at a high generation ratio and moreover, this is not accompanied with adverse effects such as desilvering failure, precipitation of crystal and worsening of image preservability.

The above-described objects can be attained by the present invention having the following constitutions.

1. A solid bleach-fixing composition for a silver halide color photographic light-sensitive material, comprising at least one compound represented by formula (I):

Formula (I):

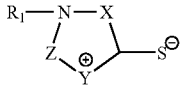

wherein X represents N or C—$R_2$; Y represents O, S or N—$R_3$; Z represents N, N—$R_4$ or C—$R_5$; and $R_1$, $R_2$, $R_3$, $R_4$ and $R_5$ each represents an alkyl group, a cycloalkyl group, an alkenyl group, an alkynyl group, an aralkyl group, an aryl group, a heterocyclic group, an amino group, an acylamino group, a sulfonamide group, a ureido group, a sulfamoylamino group, an acyl group, a thioacyl group, a carbamoyl group or a thiocarbamoyl group, provided that $R_2$ and $R_5$ each may be a hydrogen atom and that $R_1$ and $R_2$, $R_1$ and $R_4$, $R_1$ and $R_5$, or $R_3$, $R_4$ and $R_5$ may form a ring.

2. The solid bleach-fixing composition for a silver halide color photographic light-sensitive material as described in 1 above, wherein the compound represented by formula (I) is a compound represented by formula (Ia):

Formula (Ia):

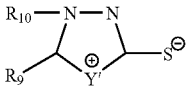

wherein Y' represents N—$R_6$ or $NNR_7R_8$; and $R_6$, $R_7$, $R_8$, $R_9$ and $R_{10}$ are be the same or different and each represents a substituted or unsubstituted alkyl group having from 1 to 6 carbon atoms, provided that $R_7$, $R_8$ and $R_9$ each may be a hydrogen atom and that at least one of $R_6$, $R_7$, $R_8$, $R_9$ and $R_{10}$ is substituted by at least one carboxylic acid group or sulfonic acid group.

3. The solid bleach-fixing composition for a silver halide color photographic light-sensitive material as described in 1 or 2 above, which contains substantially no thiosulfate.

4. The solid bleach-fixing composition for a silver halide color photographic light-sensitive material as described in 2 or 3 above, which comprises at least one compound represented by formula (Ia) and a silver complex salt of said least one compound represented by formula (Ia)

5. The solid bleach-fixing composition for a silver halide color photographic light-sensitive material as described in any one of 1 to 4, which is a granular bleach-fixing composition.

6. The solid bleach-fixing composition for a silver halide color photographic light-sensitive material as described in any one of 1 to 5, which is a tablet bleach-fixing composition.

The present invention is characterized by incorporating a specific mesoion compound represented by formula (I) into a solid bleach-fixing composition. The solid bleach-fixing composition where this specific mesoion compound is present is compact and stable without undergoing consolidation or deliquescence even when stored for a ling period of time in a high-temperature high-humidity environment and in addition, this solid bleach-fixing composition can have unexpected stability that the generation of insoluble matters can be prevented even when stored for a long period of time in a high-temperature high-humidity environment.

Such excellent long-term storability is remarkably exerted particularly when a compound represented by formula (Ia) is used as the mesoion compound.

The another characteristic feature of the present invention is that even when the solid bleach-fixing composition contains a silver complex salt, decomposition and coloration of the silver complex does not occur but the co-presence of silver complex salt rather yields an effect of more stabilizing the composition. A silver salt in a solid state and present together with a reducing fixing agent generally decomposes and brings about coloration due to silver produced, but when the above-described specific mesoion compound is present in the solid bleach-fixing composition, an unexpected stabilization effect is yielded as described above and this is also a particularly preferred embodiment of the present invention.

When the solid bleach-fixing composition contains the above-described specific mesoion compound and does not contain a thiosulfate, the composition is free from oxidative deterioration and stable without undergoing consolidation or deliquescence and this is another preferred embodiment of the present invention.

7. A method for processing a silver halide color photographic light-sensitive material, comprising: using a bleach-fixing solution containing at least one compound represented by formula (I) to generate a used bleach-fixing solution; and regenerating 50 mass % or more of the used bleach-fixing solution as a bleach-fixing processing agent for replenishment:

Formula (I):

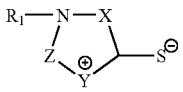

wherein X represents N or C—$R_2$; Y represents O, S or N—$R_3$; Z represents N, N—$R_4$ or C—$R_5$; and $R_1$, $R_2$, $R_3$, $R_4$ and $R_5$ each represents an alkyl group, a cycloalkyl group, an alkenyl group, an alkynyl group, an aralkyl group, an aryl group, a heterocyclic group, an amino group, an acylamino group, a sulfonamide group, a ureido group, a sulfamoylamino group, an acyl group, a thioacyl group, a carbamoyl group or a thiocarbamoyl group, provided that $R_2$ and $R_5$ each may be a hydrogen atom and that $R_1$ and $R_2$, $R_1$ and $R_4$, $R_1$ and $R_5$, or $R_3$, $R_4$ and $R_5$ may form a ring.

8. A method for processing a silver halide color photographic light-sensitive material, comprising: using a bleach-fixing solution containing at least one compound represented by formula (I), so as to generate the used bleach-fixing solution; using a rinsing solution, so as to generate a used rinsing solution; and regenerating and 30 mass % or more of a used mixed solution of the used bleach-fixing solution and the used rinsing solution, as a bleach-fixing processing agent for replenishment:

Formula (I):

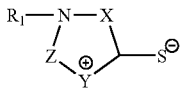

wherein X represents N or C—$R_2$; Y represents O, S or N—$R_3$; Z represents N, N—$R_4$ or C—$R_5$; and $R_1$, $R_2$, $R_3$, $R_4$ and $R_5$ each represents an alkyl group, a cycloalkyl group, an alkenyl group, an alkynyl group, an aralkyl group, an aryl group, a heterocyclic group, an amino group, an acylamino group, a sulfonamide group, a ureido group, a sulfamoylamino group, an acyl group, a thioacyl group, a carbamoyl group or a thiocarbamoyl group, provided that $R_2$ and $R_5$ each may be a hydrogen atom and that $R_1$ and $R_2$, $R_1$ and $R_4$, $R_1$ and $R_5$, or $R_3$, $R_4$ and $R_5$ may form a ring.

9. The method for processing a silver halide color photographic light-sensitive material as described in 7. or 8. above, wherein the compound represented by formula (I) is a compound represented by formula (Ia):

Formula (Ia):

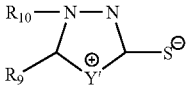

wherein Y' represents N—$R_6$ or $NNR_7R_8$; and $R_6$, $R_7$, $R_8$, $R_9$ and $R_{10}$ are be the same or different and each represents a substituted or unsubstituted alkyl group having from 1 to 6 carbon atoms, provided that $R_7$, $R_8$ and $R_9$ each may be a hydrogen atom and that at least one of $R_6$, $R_7$, $R_8$, $R_9$ and $R_{10}$ is substituted by at least one carboxylic acid group or sulfonic acid group.

10. The method for processing a silver halide color photographic light-sensitive material as described in any one of 7. to 9. above, wherein the used bleach-fixing solution or the used mixed solution is concentrated and/or dried up and then recycled and used as a bleach-fixing processing agent for replenishment.

11. The method for processing a silver halide color photographic light-sensitive material as described in 10. above, wherein the bleach-fixing processing agent for replenishment is a solid processing agent.

The present invention is characterized by incorporating a specific mesoion compound represented by formula (I) into a bleach-fixing solution. By containing this specific mesoion compound, even when compositional changes accompanying use are caused, such as increase of reductant of bleaching agent or increase in the silver ion concentration or in the halogen ion concentration, the bleach-fixing solution can be remarkably prevented from reduction in the bleach-fixing activity and the reuse ratio of the used bleach-fixing waste solution can be enhanced to at least 50%. In the case of processing the silver halide light-sensitive material by employing a system of supplying the overflow of the rinsing solution to the bleach-fixing solution, the above-described effect can be obtained also on the used bleach-fixing solution containing the rinsing solution supplied and 30% or more of even the used rinsing solution-containing bleach-fixing solution can be regenerated and used. That is, the used rinsing solution can also be regenerated and used as the bleach-fixing agent.

The embodiment of more elevating the effect of the present invention is a processing method where the used bleach-fixing solution and the used rinsing solution are concentrated and/or dried up and then regenerated and used as a bleach-fixing processing agent for replenishment. In this case, the water content in the used solution is removed in advance of the regeneration operation and therefore, a higher regeneration ratio can be obtained. Particularly, in the case of regenerating the used solution as a solid bleach-fixing processing agent for replenishment, a high regeneration ratio and in turn, a remarkably small discharge amount of the waste solution can be achieved.

This excellent long-term preservability is exerted particularly when a compound represented by formula (Ia) is used as the mesoion compound.

DETAILED DESCRIPTION OF THE INVENTION

The present invention is described in more detail below.

[Solid Bleach-Fixing Composition]

The compound represented by formula (I) for use in the present invention is first described.

Formula (I):

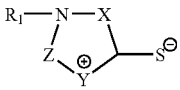

wherein X represents N or C—$R_2$, Y represents O, S or N—$R_3$, Z represents N, N—$R_4$ or C—$R_5$, $R_1$, $R_2$, $R_3$, $R_4$ and $R_5$ each represents an alkyl group, a cycloalkyl group, an alkenyl group, an alkynyl group, an aralkyl group, an aryl group, a heterocyclic group, an amino group, an acylamino group, a sulfonamide group, a ureido group, a sulfamoylamino group, an acyl group, a thioacyl group, a carbamoyl group or a thiocarbamoyl group, provided that $R_2$ and $R_5$ each may be a hydrogen atom and that $R_1$ and $R_2$, $R_1$ and $R_4$, $R_1$ and $R_5$, or $R_3$, $R_4$ and $R_5$ may form a ring. The compound represented by formula (I) is described in detail below.

$R_1$, $R_2$, $R_3$, $R_4$ and $R_5$ each represents a substituted or unsubstituted alkyl group (e.g., methyl, ethyl, n-propyl, tert-butyl, methoxyethyl, methylthioethyl, dimethylaminoethyl, morpholinoethyl, dimethylaminoethylthioethyl, aminoethyl, methylthiomethyl, trimethylammonioethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g., propargyl), a substituted or unsubstituted aralkyl group (e.g., benzyl, phenethyl, 4-methoxybenzyl), an aryl group (e.g., phenyl, naphthyl, 4-methylphenyl, 4-methoxyphenyl, 4-carboxyphenyl, 4-sulfophenyl, 3,4-disulfophenyl), a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), a substituted or unsubstituted amino group (e.g., unsubstituted amino, dimethylamino, methylamino), an acylamino group (e.g., acetylamino, benzoylamino, methoxypropionylamino), a sulfonamido group (e.g., methanesulfonamido, benzenesulfonamido, 4-toluenesulfonamido), a ureido group (e.g., unsubstituted ureido, 3-methylureido), a sulfamoylamino group (e.g., unsubstituted sulfamoylamino, 3-methylsulfamoylamino), an acyl group (e.g., acetyl, benzoyl), a thioacyl group (e.g., thioacetyl), a carbamoyl group (e.g., unsubstituted carbamoyl, dimethylcarbamoyl) or a thiocarbamoyl group (e.g., dimethylthiocarbamoyl), provided that $R_2$ and $R_5$ each may be a hydrogen atom.

In formula (I), preferably, X represents N or C—$R_2$, Y represents N—$R_3$, S or O, Z represents N or C—$R_5$, and $R_1$, $R_2$ and $R_5$ each represents a substituted or unsubstituted alkynyl group or a substituted or unsubstituted hetero-cyclic group, provided that $R_2$ and $R_5$ each may be a hydrogen atom. $R_3$ is preferably a substituted or unsubstituted alkyl group, a substituted or unsubstituted heterocyclic group, a substituted or unsubstituted amino group, a substituted or unsubstituted thioacyl group or a substituted or unsubstituted thiocarbamoyl group.

Specific examples of the compound for use in the present invention are set forth below, but the compound for use in the present invention is not limited thereto.

1

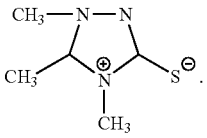

2

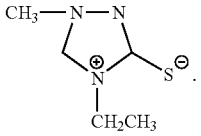

3

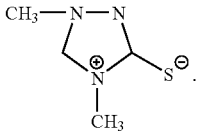

4

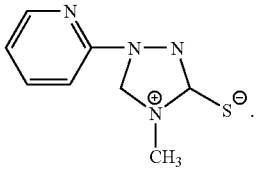

5

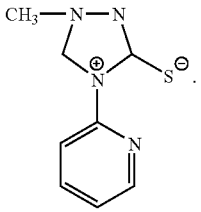

-continued

6

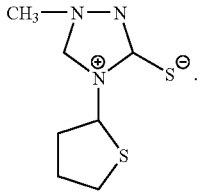

7

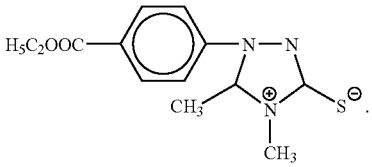

8

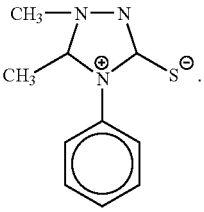

9

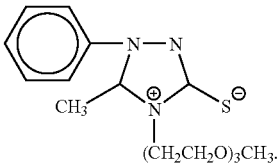

10

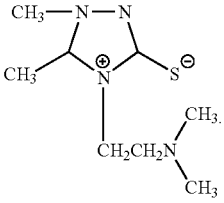

11

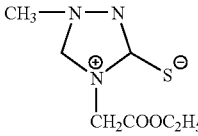

12

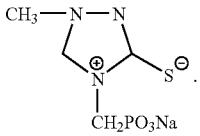

13

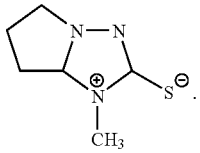

14

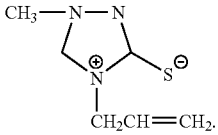

-continued
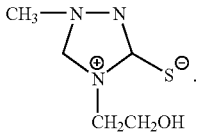
16
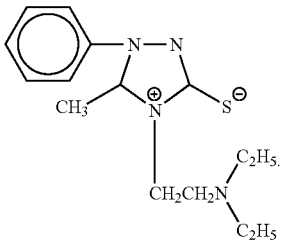
17
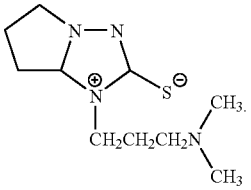
18
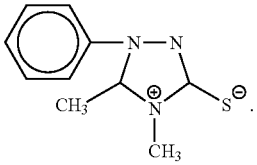
19
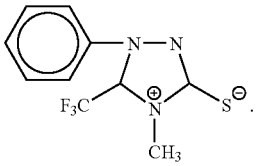
20
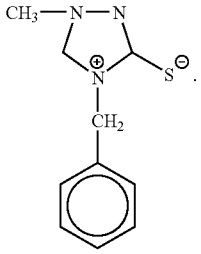
21
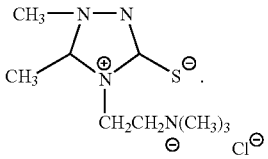
22
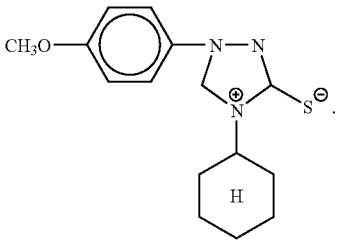
-continued
23
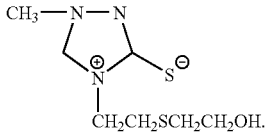
24
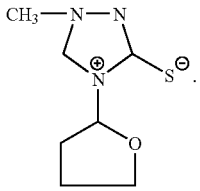
25
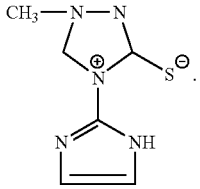
26
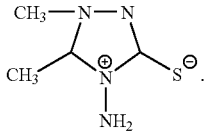
27
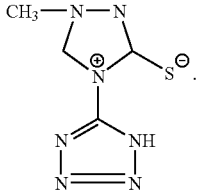
28
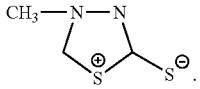
29
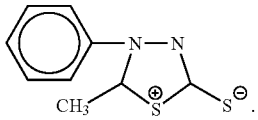
30
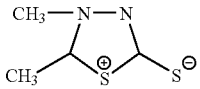
31
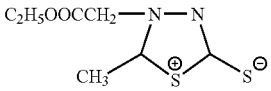
32
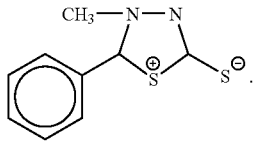
33
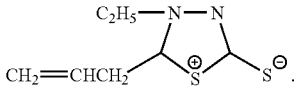

-continued
34
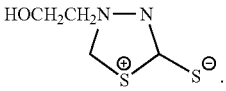
35
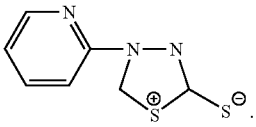
36
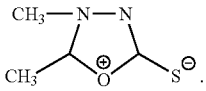
37
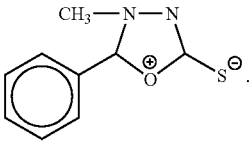
38
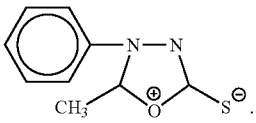
39
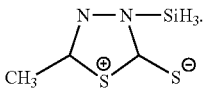
40
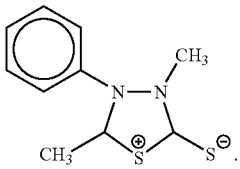
41
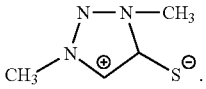
42
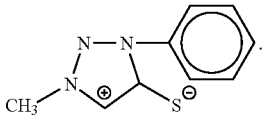
43
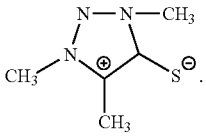
44
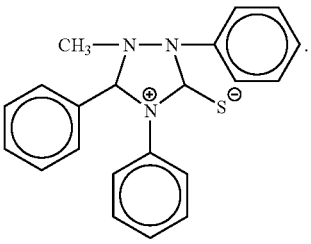
-continued
45
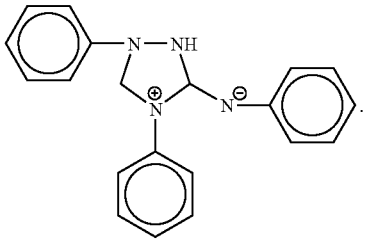
46
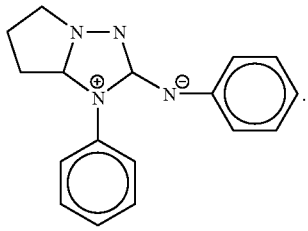
47
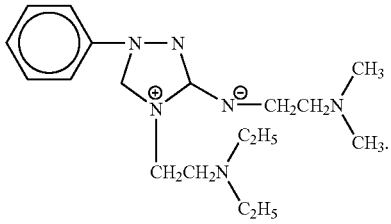
48
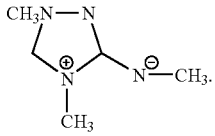
49
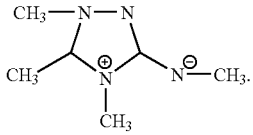
50
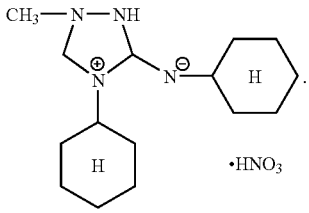
51
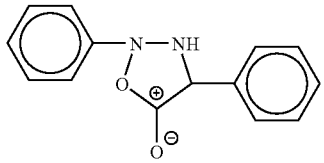
52
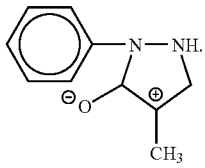

-continued

53

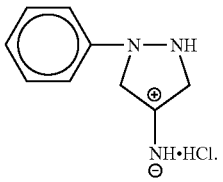

54

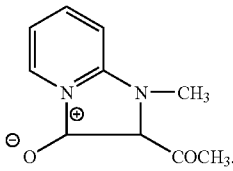

55

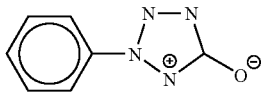

56

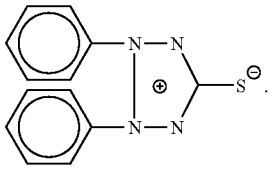

57

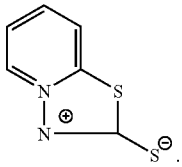

58

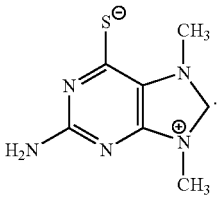

59

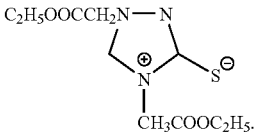

60

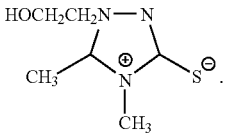

61

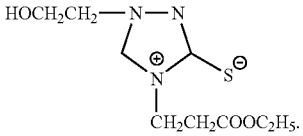

62

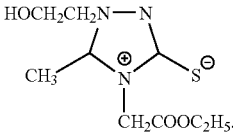

-continued

63

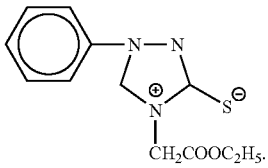

64

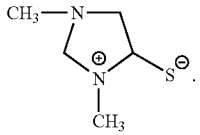

65

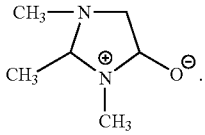

Among the compounds represented by formula (I), preferred is a compound represented by formula (Ia):

Formula (Ia):

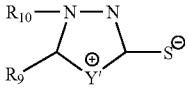

wherein Y' represents N—$R_6$ or $NNR_7R_8$, and $R_6$, $R_7$, $R_8$, $R_9$ and $R_{10}$ may be the same or different and each represents a substituted or unsubstituted alkyl group having from 1 to 6 carbon atoms, provided that $R_7$, $R_8$ and $R_9$ each may be a hydrogen atom and that at least one alkyl group of $R_6$, $R_7$, $R_8$, $R_9$ and $R_{10}$ is substituted by at least one carboxylic acid group or sulfonic acid group.

Specific examples of the compound represented by formula (Ia) are set forth below, but the compound for use in the present invention is not limited thereto.

Ia-1

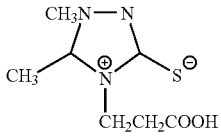

Ia-2

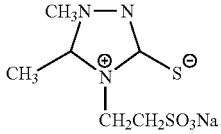

Ia-3

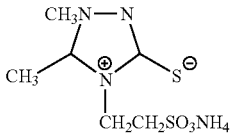

-continued

Ia-4

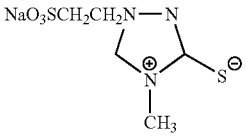

Ia-5

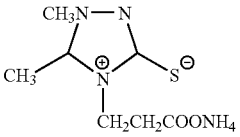

Ia-6

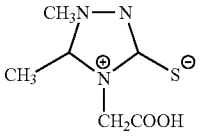

Ia-7

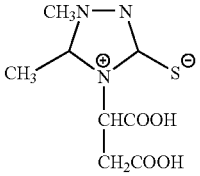

Ia-8

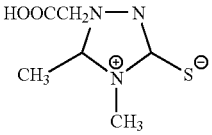

Ia-9

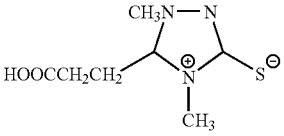

Ia-10

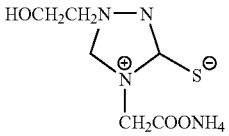

Ia-11

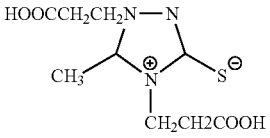

Ia-12

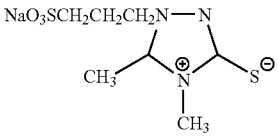

Ia-13

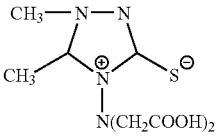

-continued

Ia-14

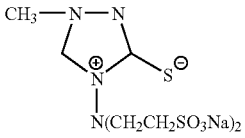

Ia-15

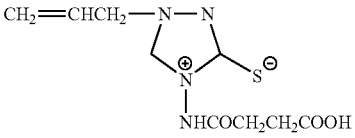

Ia-16

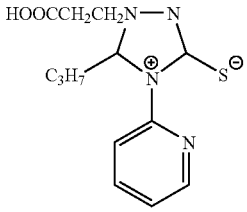

Ia-17

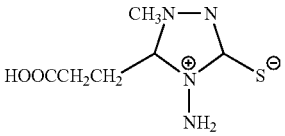

Ia-18

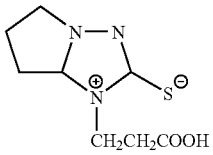

Ia-19

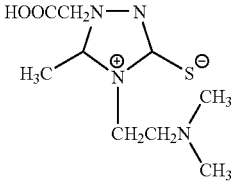

Ia-20

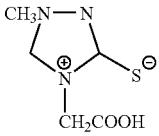

Ia-21

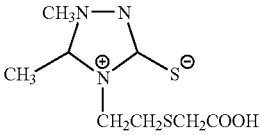

The compounds represented by formulae (I) and (Ia) for use in the present invention can be synthesized by the methods described, for example, in *J. Heterocyclic Chem.,* Vol. 2, page 105 (1965) and Vol. 5, page 277 (1968), *J. Org. Chem.,* Vol. 30, page 567 (1965) and Vol. 32, page 2245 (1967), *J. Chem. Soc.,* Vol. 80, page 1895 (1958), Vol. 57, page 899 (1935) and Vol. 81, pages 2 and 865 (1959), *Chem. Commun.,* pages 1222 and 1224 (1971), *Tetrahedron Lett.,* page 2939 (1972), page 5881 (1968), page 1809 (1967), page 1578 (1971), JP-A-60-87322, *Berichte der Deutschen Chemischen Gassellschaft,* Vol. 38, page 4049 (1905), JP-A-

60-122936, JP-A-60-117240, *Advances in Heterocyclic Chemistry,* Vol. 19, page 1 (1976), and *J. Chem. Soc., Perkin Trans.* 1, page 627 (1974), but synthesis examples of representative compounds are described below.

SYNTHESIS EXAMPLE 1

Synthesis of Compound Ia-1

(1) Synthesis of 2-methoxycarbonylethyl isocyanate

To a solution containing 603.6 g of β-alanine-methylester sulfate and 1.5 liter of methyl alcohol, 1,256 ml of triethylamine was added at a freezing point and thereto, 235 ml of carbon disulfide was added dropwise at 10° C. or less. After the dropwise addition, the solution was stirred at 10° C. or less for 1 hour and then 288 ml of ethylchloroformate was added dropwise and in this state, the solution was stirred for 2 hours. After the reaction, the reaction solution was subjected to liquid separation with ethyl acetate and water. The extracted ethyl acetate layer was dried over magnesium sulfate and filtered and then the ethyl acetate was removed by distillation under reduced pressure to 389.1 g (yield: 89.3%) of the objective compound as an oily product.

(2) Synthesis of 1-acetyl-1-methyl-4-methoxycarbonylethyl thiosemicarbizide

A mixed solution containing 101.6 g of 2-methoxycarbonylethyl isocyanate synthesized in (1), 61.7 g of 1-acetyl-1-methylhydrazine and 150 ml of methyl alcohol was refluxed under heat for 2 hours and after removing methyl alcohol by distillation under reduced pressure, 500 ml of ethyl acetate was added to the residue. The crystals precipitated were collected by filtration to obtain 105.0 g (yield: 64.3%) of the objective compound.

(3) Synthesis of mesoion-1,5-dimethyl-4-methoxycarbonylethyl-1,2,4-triazolium-3-thiolate To 93.3 g of 1-acetyl-1-methyl-4-methoxycarbonylethyl thiosemicarbizide synthesized in (2), 300 ml of methyl alcohol and 10 ml of a 28% methyl alcohol solution of sodium methoxide were added and stirred for 2 hours at room temperature. The crystals precipitated were collected by filtration to obtain 67.2 g (yield: 78.0%) of the objective compound. Melting point: 139–140° C.

(4) Synthesis of mesoion-4-carboxyethyl-1,5-dimethyl-1,2,4-triazolium-3-thiolate To 64.6 g of mesoion-1,5-dimethyl-4-methoxycarbonylethyl-1,2,4-triazolium-3-thiolate, 300 ml of water was added and the compound was dissolved. Thereto, 100 ml of 5N sodium hydroxide was added and stirred under heat for 2 hours at 30° C. After the reaction, the reaction solution was neutralized by adding 45 ml of concentrated sulfuric acid and dried up and the residue was recrystallized from 100 ml of water to obtain 49.3 g (yield: 81.6%) of the objective compound. Melting point: 214 to 215° C.

The obtained compound was confirmed as the objective compound by NMR, IR, mask vector and elemental analysis.

SYNTHESIS EXAMPLE 2

Synthesis of Compound Ia-2

(1) Synthesis of 1-acetyl-1-methyl-4-sulfoethyl thiosemicarbazide sodium salt

To a solution obtained by adding 600 ml of methyl alcohol and 300 ml of water to 114.2 g of 1-acetyl-1-methylhydrazine, 175.3 g of sulfoethyl isocyanate was added. The resulting solution was refluxed under heat for 4 hours. After the reaction, the reaction solution was dried up under reduced pressure and the obtained solid matter was recrystallized from 1 liter of methyl alcohol to obtain 169.4 g (yield: 66.0%) of the objective compound. Melting point: 255 to 256° C.

(2) Synthesis of mesoion-1,5-dimethyl-4-sulfoethyl-1,2,4-triazolium-3-thiolate sodium salt To 139.8 g of 1-acetyl-1-methyl-4-sulfoethyl thiosemicarbazide sodium salt synthesized in (1), 850 ml of methyl alcohol and 5 ml of a 28% methyl alcohol solution of sodium methoxide were added. The resulting solution was refluxed under heat for 3 hours. After cooling to room temperature, the crystals precipitated were collected by filtration and recrystallized from 2 liter of a mixed solvent of methyl alcohol:water (=9:1) to obtain 99.3 g (yield: 67.9%) of the objective compound. Melting point: 300° C. or more.

The obtained compound was confirmed as the objective compound by NMR, IR, mask vector and elemental analysis.

SYNTHESIS EXAMPLE 3

Synthesis of Compound Ia-20

By using methoxycarbonylmethyl isothiocyanate synthesized in the same manner as in Synthesis Example 1-(1) and 1-formyl-1-methylhydrazine, the objective mesoion-4-carboxymethyl-1-methyl-1,2,4-triazolium-3-thiolate was synthesized in the same manner as in Synthesis Example 1. Melting point: 231 to 232° C.

As for the mesoion compound, for example, 1,2,4-triazolium-3-thiolate compound is disclosed as the fixing agent in JP-A-57-150842. Also, the compound is used alone as the desilvering agent in JP-A-4-143755 and JP-A-4-143757 and used in combination with ammonium thiosulfate in JP-A-4-130431, JP-A-4-143756, JP-A-4-170539 and JP-A-4-229860, but these patent publication are silent on a kit for the solid fixing agent and on the regeneration use of the processing solution.

Furthermore, the bleach-fixing solution having bleaching ability, particularly, solid processing agent is described in JP-A-5-333507, but it is not disclosed to incorporate a mesoion compound.

The solid bleach-fixing composition of the present invention is added to water, a running solution, a used bleach-fixing solution or the like to constitute a bleach-fixing solution or a bleach-fixing replenisher and therefore, other components which may be contained in this composition are described together in the section on Bleach-Fixing Solution or Bleach-Fixing Replenisher in Processing and Processing Step described later.

The compound represented by formula (I) or (Ia) is preferably contained in the solid bleach-fixing agent in an amount of 5 to 70 mass %, more preferably from 10 to 60 mass %, and most preferably from 20 to 50 mass %, based on the solid bleach-fixing agent.

In the case of incorporating a silver complex of the compound of formula (I) and/or formula (Ia) into the bleach-fixing agent, the content thereof is preferably from 0.01 to 10 mass %, more preferably from 0.05 to 5 mass %, and most preferably from 0.1 to 2 mass %, based on the solid bleach-fixing agent.

The bleach-fixing solution is preferably used at a pH of 5.0 to 9.0, more preferably from 6.0 to 8.5. The pH as used herein means a pH of a processing tank at the processing of a silver halide light-sensitive material.

The bleach-fixing solution is suitably used at a temperature of 20 to 50° C., preferably from 25 to 45° C.

The processing time by the bleach-fixing solution is not particularly limited but is preferably 3 minutes and 30 seconds or less, more preferably from 10 seconds to 2 minutes and 20 seconds.

As described above, in the processing method of the present invention, the operation of removing silver ion from the used bleach-fixing solution can be omitted.

If silver ion is positively removed and the processing is performed after removing the silver ion to a concentration of about 0.01 mol/liter or less as in conventionally known techniques, desilvering failure or leuconization of cyan dye is readily caused due to generation of ion (II) complex or accumulation of sulfate ion in, for example electrolytic process. Also, in the case of using a metal ion, an extremely large amount of iron (II) complex is produced, as a result, the oxidizing power of the bleach-fixing solution is decreased and desilvering failure is liable to occur. Therefore, in the present invention, a technique of regenerating the bleach-fixing solution by using a compound represented by formula (I) without causing extreme reduction in the silver ion concentration is provided. If the accumulate amount of silver ion concentration is merely increased, the desilvering rate decreases as described in JP-A-50-145231, but this trouble can be avoided by the present invention.

[Method for Formation into Solid]

The solid bleach-fixing composition of the present invention may be in any form of a powder, a granule and a tablet, but is preferably in the form of a granule or a tablet.

In a particularly preferred embodiment of the method of the present invention, the used bleach-fixing solution or the used bleach-fixing solution and rinsing solution is concentrated or concentrated and dried up and then regenerated and used as a concentrated or solid bleach-fixing agent for replenishment.

Here, the solid bleach-fixing composition of the present invention can be preferably used as the solid processing agent.

The concentrated processing agent is prepared as a liquid processing solution at a concentration magnification of 2 to 10 times, preferably from 2.5 to 5 times, from the used and concentrated solution.

In the case of a powder, a powder composition is prepared, for example, by a method of forming respective constituent components into a powder, if desired, by grinding these to adjust the particle size and mixing powder raw materials at a ratio of prescribed formulation values or by a method of dissolving respective constituent components in a solvent such as water and forming the solution into a powder by appropriate drying such as spray drying.

The powder processing solution can be produced by a general method described, for example, in JP-A-54-133332, British Patents 725892 and 729862 and German Patent 3,733,861.

In the case of a tablet, respective components are formed into a powder, if desired, by grinding these to adjust the particle size and powder raw materials are mixed at a ratio of prescribed formulation values and then shaped. Also, a method of dissolving respective constituent components in a solvent such as water, forming the solution into a powder by appropriate drying such as spray drying, and then shaping the powder may be used. If desired, an appropriate binder is added so as to attain mechanical strength or stabilization of the tablet. Examples of the binder which can be used include water-soluble binders such as polyvinyl alcohol-base binder and methyl cellulose-base binder, and the binders described in JP-A-5-333507 (paragraph 0066).

The tablet processing agent can be produced by a general method described, for example, in JP-A-51-61837, JP-A-54-155038, JP-A-52-88025 and British Patent 1213808. In addition, a tablet can be formed by the granulation methods (2), (4), (5) and (6), particularly methods (2) and (4), described in *Zoryu Handbook* (*Granulation Handbook*) referred to later regarding the granulation method of a granular processing agent.

The tablet is not particularly limited in the shape and may have, for example, a spherical, plate-like, disc-like or amorphous shape. The size of the tablet is also not particularly limited as long as it is an easily handleable size, but the long diameter is preferably from 5 to 30 mm, more preferably from 8 to 20 mm.

The granular processing agent can be produced by a general method described, for example, in JP-A-2-109042, JP-A-2-109043, JP-A-3-39735, JP-A-3-39739 and JP-A-2001-183780.

In the present invention, the spherical granule indicates a particle obtained by granulating a powder into a spherical shape. The spherical shape may or may not be a true sphere and includes particle shapes generally called pellet, pill, bead or the like. In the present invention, the average particle size of spherical granules is preferably from 0.5 to 20 mm, more preferably from 1 to 15 mm, still more preferably from 2 to 10 mm. When granules having an average particle size of 0.5 mm or less are occupying 10 mass % or less, preferably from 0 to 5 mass %, of the granular solid processing agent, the effect of the present invention is remarkably brought out.

In the present invention, preferred embodiments of the granular solid processing agent are a core-shell granule and a multilayer granule. In such a case, a component of less undergoing consolidation or deliquescence can be disposed in the surface coating layer and this is more effective in view of the object of the present invention.

The preparation method of the granular solid processing agent is described in detail in JP-A-2001-183779 and JP-A-2001-183779.

The granule can be granulated in various shapes such as spherical shape, cylindrical shape, prismatic shape and amorphous shape. The average particle size thereof is preferably from 0.1 to 10 mm, more preferably from 0.2 to 8 mm, still more preferably from 0.3 to 5 mm.

In the present invention, the granule can be produced by various known granulation methods including the production methods of a core-shell granule or a multilayer granule. These various granulation methods applicable to the present invention are described in *Zoryu Handbook* (*Granulation Handbook*), compiled by Nippon Funtai Kogyo Gijutsu Kyokai, and also described, for example, in JP-A-4-221951 and JP-A-2-109043. Among these, representative preferred granulation methods are described below, but the present invention is not limited thereto.

(1) Rolling Granulation Method (*Zoryu Handbook,* p. 133)

A method of spraying a liquid (binder) while rolling the raw material powder in a rotary container such as rotary drum or rotary dish and agglomerating the powder into a snowball by using the surface energy as the motive power.

(2) Compression Granulation Method (*Zoryu Handbook,* p. 199)

A method called briquetting of compressing and shaping the powder raw material between rotating two rolls into granules by using briquette pockets engraved on the roll surface, and a method called compacting of shaping the raw material powder into surface-smooth plate-like flakes and then crushing these flakes.

(3) Stirring Granulation Method (*Zoryu Handbook,* p. 379)

A method of forcibly giving a flow motion to the raw material powder by using a stirring blade or the like provided inside a container and agglomerating and granulating the powder while spraying a liquid.

(4) Extrusion Granulation Method (*Zoryu Handbook,* p. 169)

A method of granulating the raw material by extruding it from a die or from pores of a screen. Examples of the extruding mechanism used therefor include screw type, roll type, blade type, self-shaping type and ram type.

(5) Crushing Granulation Method (*Zoryu Handbook,* p. 349)

This method includes a dry process and a wet process. The dry process is a method of crushing briquettes or compact flakes obtained by the above-described compression granulation method and thereby obtaining granules. The wet process is a method of kneading the previously humidified powder material and granulating by crushing the kneaded product. In either case, compression, crushing and fractionation are performed by applying impact with a hammer or shear with a cutter or the like or by using an irregular tooth roll or a corrugated roll.

(6) Fluidized Bed Granulation Method (*Zoryu Handbook,* p. 283)

A method of granulating the raw material powder by spraying a binder while maintaining the powder in a state of floating and suspending in a fluid blowing upward. This operation belongs to a unit operation called fluidization, but a fluidized bed multifunctional granulating machine where this operation is combined with rolling and stirring can also be used.

(7) Coating Granulation Method (*Zoryu Handbook,* p. 409)

A granulation method of spraying a coating material or binder solution on a core and attaching the carrying particles on the core surface. Examples of this method include pan coating performed under rolling by a rotary drum, rolling coating performed under rolling by a rotary disc, fluidized bed coating of forming a fluidized bed by air flow, and centrifugal flow-type coating of causing a planetary motion by using a centrifugal force generated due to rotation of a rotor, and a slit air.

(8) Melting Granulation Method (*Zoryu Handbook,* p. 227)

A method of fractionating or flaking a molten material by ejection or dripping on a plate and then cooling and solidifying the fractions or flakes.

(9) Spray Drying Granulation Method (*Zoryu Handbook,* p. 249)

A granulation method of spraying and atomizing a solution, paste, suspension or the like in a hot air stream within a drying tower and at the same time, evaporating the water content to obtain dry particles.

(10) Liquid Phase Granulation Method (*Zoryu Handbook,* p. 439)

A capsule granulation method known as a production method for microcapsule. Examples of this method include an interfacial polymerization method, an in-liquid hardening coating method, an emulsion method, an inclusion exchange method and a spray drying method.

(11) Vacuum Freezing Granulation Method (*Zoryu Handbook,* p. 469)

A method of forming a particulate material by utilizing a frozen (cooled and solidified) state from a wet material incapable of maintaining the particle shape at ordinary temperature.

In the present invention, the inside core is preferably granulated by a compression granulation method, more preferably by a compacting method because the effect of the present invention is remarkably brought out. Also, the coating on the inside core is preferably performed by a rolling granulation method, a fluidized bed granulation method or a coating granulation method, more preferably by a coating granulation method using a centrifugal flow-type coating machine because the effect of the present invention can be effectively brought out.

In the present invention, the tablet or granular processing agent is preferably surface-coated with a water-soluble polymer. The kind of the water-soluble polymer used for the coating is not limited and, for example, one or more selected from synthetic, semisynthetic and natural water-soluble polymer substances can be used, such as gelatin, pectin, polyacrylic acid, polyacrylate, polyvinyl alcohol, modified polyvinyl alcohol, polyvinylpyrrolidone, polyvinylpyrrolidone.vinyl acetate copolymer, polyethylene glycol, carboxymethyl cellulose sodium salt, hydroxypropyl-methyl cellulose, hydroxyethyl cellulose, hydroxypropyl cellulose, methyl cellulose, ethyl cellulose, alginate, xanthane gum, gum arabic, tragacanth gum, karaya gum, carrageenan and methylvinyl ether.maleic anhydride copolymer. Among these, one or more or polyethylene glycol, polyvinylpyrrolidone, hydroxypropyl cellulose, methyl cellulose, gum arabic and carrageenan is(are) preferably used in the present invention.

The coating amount of the water-soluble polymer is not particularly limited as long as it is a coating amount usually employed, but the coating amount is preferably from 0.001 to 10 mass %, more preferably from 0.01 to 5 mass %, based on the tablet or granule. For the coating of the water-soluble polymer, known methods can be used without any particular limitation, but the above-described rolling granulation method, stirring granulation method, fluidized bed granulation method, coating granulation method, melting granulation method and spray drying granulation method are preferably used. In particular, the coating is preferably performed by a method of spray-coating an aqueous polymer solution in a concentration of 1 to 50% on the surface of a granule by the rolling granulation method, fluidized bed granulation method, coating granulation method or spray granulation method, and then drying the solution.

In the case where the solid processing composition is a granular processing agent, this may be constituted by individual parts without mixing different granules constituting the processing agent or may be constituted by one part obtained by mixing multiple kinds of granules. The "part" used here means a partial constitutional processing agent constituting the processing agent as is generally used in the industry and defined by the International Standard (ISO 5989), and the processing solution is obtained by dissolving respective parts in one solution.

The container for the tablet or granular processing agent for use in the present invention has a shape such as bag or bottle, and the package material therefor may be any material such as paper, plastic and metal. In view of load on the environment, a bag- or bottle-like container made of paper or plastic film is preferred. Also, in view of various kinds of stability, a package material having barrier property is preferred. In particular, a plastic material having an oxygen permeability of 200 ml/$m^2$·24 hrs·Pa or less is preferred. The oxygen permeation coefficient can be measured by the method described in N. J. Calyan, *$O_2$ Permeation of Plastic Container, Modern Packing,* pp. 143–145 (December, 1968). Specific preferred examples of the plastic material include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA) and polyethylene terephthalate (PET). Among these, PVDC, NY, PE, EVA, EVAL and PET are preferred in the present invention for the purpose of reducing the oxygen permeability.

As for the specific package form of the tablet or granular processing agent, the package material is shaped into a film, a bag or a bottle. In the case of packaging a solid photographic processing agent with a film having barrier property, the film preferably has a thickness of 10 to 150 μm for protecting the processing agent from moisture. The package material having barrier property is preferably a composite material using one or more member selected from a polyolefin film (e.g., polyethylene terephthalate, polyethylene, polypropylene), kraft paper capable of having moisture-resisting effect with polyethylene, waxed paper, moisture-resistant cellophane, glassine, polyester, polystyrene, polyvinyl chloride, a vinylidene chloride-maleic acid copolymer, polyvinylidene chloride, polyamide, polycarbonate, acrylonitrile, a metal foil (e.g., aluminum) and a metallized polymer film.

Examples of the composite material include polyethylene terephthalate/low-density polyethylene, vinylidene chloride-maleic acid copolymer-coated cellophane/low-density polyethylene, polyethylene terephthalate/vinylidene chloride-maleic acid copolymer/low-density polyethylene, nylon/low-density polyethylene, low-density polyethylene/vinylidene chloride-maleic acid copolymer/low-density polyethylene, nylon/EVAL/low-density polyethylene, polyethylene terephthalate/EVAL/low-density polyethylene, and aluminum-deposited polyethylene terephthalate. A package material formed of a high barrier (high blocking) film comprising such a composite material is particularly preferred because of its high blocking property for water, gas, light, etc., fastness, flexibility, sealability (processability) and the like. As for the high barrier package material, those described, for example, in *Kinosei Hoso Zairyo no Shin Tenkai* (*Development of New Functional Package Materials*), Toray Research Center (February, 1990) can be used.

In addition, the low oxygen permeable or low vapor permeable containers disclosed in JP-A-63-17453, and the vacuum package materials disclosed in JP-A-4-19655 and JP-A-4-230748 can also be preferably used as the container material.

In one embodiment, the solid processing agent of the present invention can be used for the development by mounting it together with a container on an automatic developing machine. In this case, the container is preferably a container produced by using, as a single constituent resin, a high-density polyethylene (hereinafter referred to as HDPE) having a density of 0.941 to 0.969 and a melt index of from 0.3 to 5.0 g/10 min. The density is more preferably from 0.951 to 0.969, still more preferably from 0.955 to 0.965, and the melt index is more preferably from 0.3 to 5.0 g/10 min, still more preferably from 0.3 to 4.0 g/10 min. The melt index is a value measured in accordance with the method prescribed in ASTM D1238 at a temperature of 190° C. under a load of 2.16 kg. This container is preferably produced to have a thickness of 500 to 1,500 μm. However, the processing agent container for use in the present invention is not limited to the HDPE container which is convenient for the mounting on a developing machine, but a container made of a general-purpose container material other than HDPE, such as polyethylene terephthalate (PET), polyvinyl chloride (PVC), and low-density polyethylene (LDPE), or made of HDPE having a density and a melt index out of respective ranges described above can also be used.

[Processing Step]

The processing steps using the processing agent of the present invention are described below. The development processing to which the present invention is applied comprises a color developing step, a desilvering step, a water washing or stabilizing bath step and a drying step. Between respective steps, an auxiliary step such as rinsing step, intermediate water washing step and neutralizing step may be inserted. The desilvering step is performed by using a bleach-fixing solution. Also, apart from the water washing-substituting stabilizing bath provided instead of a water washing step, an image stabilizing bath for the purpose of stabilizing an image can be provided between a water washing or stabilizing bath step and a drying step. In the case of a black-and-white photographic material, the development processing comprises a developing step, a fixing step, a water washing step and a drying step, and between respective steps, an auxiliary step such as intermediate water washing step including rinsing and neutralization step can be provided. The processing method of the present invention may be a rapid development-type processing method, a low replenishment-type processing method or an internationally compatible standard-type processing method.

The color developing step is an immersion bath processing step of immersing the light-sensitive material in a developer, and the developer is an alkaline continuous phase liquid containing constituent components in a dissolved state. A developer and a development replenisher are prepared and used in a developing tank and a replenishing tank, respectively.

[Photographic Processing Solution]

The photographic processing solution for use in the photographic processing, including a bleach-fixing solution and a bleach-fixing replenisher each prepared by using the solid processing composition of the present invention, is described below.

The photographic processing solution includes a color processing solution, a black-and-white processing solution, a reducer used in the plate-making operation, a development processing tank-washing solution and the like, and examples thereof include a black-and-white developer, a color developer, a fixing solution, a bleaching solution, a bleach-fixing solution and an image stabilizing solution.

The color developer usually contains an aromatic primary amine color developing agent as the main component and the color developing agent is mainly a p-phenylenediamine derivative. Representative examples thereof include N,N-diethyl-p-phenylenediamine, 2-amino-5-diethylaminotoluene, 2-methyl-4-[N-ethyl-N-(β-hydroxyethyl)amino]aniline and N-ethyl-N-(β-methanesulfon-amidoethyl)-3-methyl-4-aminoaniline. These p-phenylenediamine derivatives may be in the form of a salt such as sulfate, hydrochloride, sulfite and p-toluenesulfonate. The content of the aromatic primary developing agent is about 0.5 g to about 10 g per liter of the developer.

In the black-and-white developer (first development of color reversal processing), 1-phenyl-3-pyrazolidone, 1-phenyl-4-hydroxymethyl-4-methyl-3-pyrazolidone, N-methyl-p-aminophenol or a sulfate thereof, hydroquinone or a sulfonate thereof, or the like is contained.

The color and black-and-white developers each usually contains, as a preservative, a sulfite such as sodium sulfite, potassium sulfite, sodium bisulfite, potassium bisulfite, sodium metasulfite and potassium metasulfite, or a carbonyl sulfite adduct. The content of the preservative per liter of the developer is 5 g or less, mostly 3 g or less (including no addition) in the case of a color developer, and from 0 to 50 g in the case of a black-and-white developer.

The color developer contains various hydroxylamines as a preservative. The hydroxylamines may be either substituted or unsubstituted. The substitution product includes hydroxylamines with the nitrogen atom being substituted by a lower alkyl group, particularly, N,N-dialkyl-substituted hydroxylamines substituted by two alkyl groups (for example, having from 1 to 3 carbon atoms). Also, a combination of an N,N-dialkyl-substituted hydroxylamine and an alkanolamine such as triethanolamine may be used. The content of hydroxylamines is from 0 to 5 g per liter of the developer.

The color and black-and-white developers each has a pH of 9 to 12. For maintaining the pH in this range, various buffers are used. Examples of the buffer which can be used include carbonate, phosphate, borate, tetraborate, hydroxybenzoate, glycine salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt and lysine salt. Among these, carbonate, phosphate, tetraborate and hydroxy-benzoate are advantageous in that these are excellent in the solubility and buffering ability in a high pH region of 9.0 or more, have no adverse effect (such as fogging) on the photographic performance when added to the developer, and are inexpensive, and these buffers are used in many cases. The amount of the buffer added to the developer is usually from 0.1 to 1 mol per liter of the developer.

Other than these, various chelating agents are added to the developer so as to prevent the precipitation of calcium or magnesium or improve the stability of the developer. Representative examples thereof include nitrilotriacetic acid, diethylenetriaminepentaacetic acid, nitrilo-N,N,N-trimerymetylenephosphonic acid, ethylenediamine-N,N,N',N'-tetramethylenephosphonic acid, 1,3-diamino-2-propanoltetraacetic acid, trans-cyclohexane-diaminetetraacetic acid, 1,3-diaminopropanetetraacetic acid, 2-phosphonobutane-1,2,4-tricarboxylic acid and 1-hydroxyethylidene-1,1-diphosphonic acid. These chelating agents may be used in combination of two or more thereof, if desired.

The developer contains various development accelerators. Examples of the developer accelerator include thioether-base compounds, p-phenylenediamine-base compounds, quaternary ammonium salts, p-aminophenols, amine-base compounds, polyalkylene oxides, 1-phenyl-3-pyrazolidones, hydrazines, mesoionic compounds, thionic compounds and imidazoles.

In many color developers for color paper, an alkylene glycol or a benzyl alcohol is contained together with those color developing agent, sulfite, hydroxylamine salt, carbonate, hard water softening agent and the like. On the other hand, such an alcohol is not contained in developers for color negative film, developers for color positive film and some developers for color paper.

The developer contains bromide ion in many cases for the purpose of preventing the fogging, but a developer containing no bromide ion is sometimes used for a light-sensitive material mainly comprising silver chloride. In addition, the developer sometimes contains, as an inorganic antifoggant, a compound of giving chloride ion, such as NaCl and KCl. Also, various organic antifoggants are often contained. Examples of the organic antifoggant which may be contained include adenines, benzimidazoles, benzo-triazoles and tetrazoles. The antifoggant content is from 0.010 to 2 g per liter of the developer. The antifoggant includes those dissolved out from the light-sensitive material during processing and accumulated in the developer. Particularly, in the present invention, the processing can be effectively performed even when the total halogen ion concentration such as bromide ion and chloride ion in the waste solution is 1 mmol or more per liter of the mixed solution. The present invention is effective particularly when the bromide ion concentration is 1 mmol or more per liter of the mixed solution.

The developer also contains various surfactants such as alkylphosphonic acid, aryl phosphonic acid, aliphatic carboxylic acid and aromatic carboxylic acid.

In the processing according to the present invention, a bleach-fixing processing is performed after the development processing. The bleaching agent for the bleach-fixing solution is described below.

Although a known bleaching agent may be used, the bleaching agent used in the bleach-fixing solution is preferably an organic complex salt (for example, complex salt of aminopolycarboxylic acids) of iron(III), an organic acid such as citric acid, tartaric acid and malic acid, a persulfate or a hydrogen peroxide.

Among these bleaching agents, organic complex salts of iron (III) are particularly preferred in view of rapid processing and environmental protection. Examples of the aminopolycarboxylic acid or a salt thereof useful for forming the organic complex salt of iron(III) include biodegradable ethylenediaminedisuccinic acid (SS form), N-(2-carboxylatoethyl)-L-aspartic acid, β-alaninediacetic acid, methyliminodiacetic acid, ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycol ether diaminetetraacetic acid. These compounds may be in the salt form of sodium, potassium, lithium or ammonium salt. Among these compounds, ethylenediaminedisuccinic acid (SS form), N-(2-carboxylatoethyl)-L-aspartic acid, β-alaninediacetic acid, ethylenediaminetetraacetic acid, 1,3-diaminopropanetetraacetic acid, and methyliminodiacetic acid are preferred because iron(III) complex salts thereof exhibit good photographic property. These ferric ion complex salts may be used in the complex salt form or a ferric ion complex salt may be formed in a solution by using a ferric salt such as ferric sulfate, ferric chloride, ferric nitrate, ferric ammonium sulfate and ferric phosphate, and a chelating agent such as aminopolycarboxylic acid. Also, a chelating agent may be used in excess of the amount necessary for forming a ferric ion complex salt. Among iron complexes, aminopolycarboxylic acid iron complex is preferred.

The amount of the bleaching agent added is determined to give a concentration of 0.01 to 1.0 mol/liter, preferably from 0.03 to 0.80 mol/liter, more preferably from 0.05 to 0.70 mol/liter, still more preferably from 0.07 to 0.50 mol/liter, in a processing solution prepared. The solid bleach-fixing composition is designed such that a bleach-fixing solution or bleach-fixing replenisher having a bleaching agent concentration in this range can be obtained.

The bleach-fixing solution preferably contains various known organic acids (e.g., glycolic acid, succinic acid, maleic acid, malonic acid, citric acid, sulfosuccinic acid), organic bases (e.g., imidazole, dimethylimidazole, etc.), a compound represented by formula (A-a) of JP-A-9-211819 including 2-picolinic acid, or a compound represented by formula (B-b) of the same patent publication including kojic acid. The amount of such a compound added is determined to give a concentration of preferably from 0.005 to 3.0 mol/liter, more preferably from 0.05 to 1.5 mol/liter, in a processing solution prepared. Needless to say, the solid bleach-fixing composition is designed such that a bleach-fixing solution or bleach-fixing replenisher having a concentration in this range can be obtained.

The solid bleach-fixing composition of the present invention need not always contain a thiosulfate as the fixing agent and when a thiosulfate is not contained, this is rather advantageous in that the bleach-fixing solution is lessened in the turbidity or production of precipitant.

In the case where a fixing agent other than formula (I) is used in the bleach-fixing agent, the fixing agent may be a known fixing chemical, that is, a thiosulfate such as sodium thiosulfate and ammonium thiosulfate, a thiocyanate such as sodium thiocyanate and ammonium thiocyanate, a thioether compound such as ethylene-bisthioglycolic acid and 3,6-dithia-1,8-octanediol, or a water-soluble silver halide dissolving agent such as thioureas. These compounds may be used individually or in combination of two or more thereof. Furthermore, for example, a special bleach-fixing solution described in JP-A-55-155354 comprising a combination of a fixing agent and a halide such as a large amount of potassium iodide can also be used. In the present invention, a thiosulfate, particularly, ammonium thiosulfate is preferred. The concentration of the fixing chemical in the fixing solution or bleach-fixing solution prepared from the tablet or granular processing agent is preferably from 0.3 to 3 mol, more preferably from 0.5 to 2.0 mol, per liter of the solution prepared. The solid bleach-fixing composition is designed such that a bleach-fixing solution or bleach-fixing replenisher having a concentration in this range can be obtained.

The bleach-fixing agent for use in the present invention preferably has, when dissolved, a pH in the region from 3 to 8, more preferably from 4 to 8. If the pH is less than this range, the desilvering property may be improved but deterioration of solution and leuconization of cyan dye are accelerated, whereas if the pH exceeds this range, desilvering is retarded and staining is readily generated. The bleaching solution prepared from the granular agent of the present invention has a pH in the region of 8 or less, preferably from 2 to 7, more preferably from 2 to 6. If the pH is less than this range, deterioration of solution and leuconization of cyan dye are accelerated, whereas if the pH exceeds this range, desilvering is retarded and staining is readily generated. For adjusting the pH, if desired, the above-described solid state acid, the above-described solid alkali such as potassium hydroxide, sodium hydroxide, lithium hydroxide, lithium carbonate, sodium carbonate and potassium carbonate, an acidic or alkaline buffer, or the like may be added.

Furthermore, the bleach-fixing agent may contain other various fluorescent brightening agents, defoaming agents, surfactants and polyvinylpyrrolidones. The fluorescent brightening agent can also be added to the above-described color developer to give a concentration of 0.02 to 1.0 mol/liter in the developer prepared. The bleach-fixing agent or fixing agent preferably contains, as a preservative, for example, a sulfite ion-releasing compound such as sulfite (e.g., sodium sulfite, potassium sulfite, ammonium sulfite), bisulfite (e.g., ammonium bisulfite, sodium bisulfite, potassium bisulfite) and metabisulfite (e.g., potassium metabisulfite, sodium metabisulfite, ammonium metabisulfite), an arylsulfinic acid such as p-toluenesulfinic acid and m-carboxybenzene-sulfinic acid. Such a compound is preferably contained in an amount of about 0.02 to 1.0 mol/liter in terms of sulfite ion or sulfinate ion.

In addition to these compounds, an ascorbic acid, a carbonyl bisulfite adduct, a carbonyl compound or the like may be added as a preservative.

After the completion of bleach-fixing, a water washing-substituting stabilizing bath or a stabilizing bath for stabilizing an image is used in many cases. Such a bath is low in the concentration and the effect of the granular processing agent is not so high, but if desired, a granulated processing agent may be produced. The method of reducing the amounts of calcium and magnesium described in JP-A-62-288838 is very effective for the processing agent of the stabilizing bath. Furthermore, isothiazolone compounds and thiabendazoles described in JP-A-57-8542, chlorine-based bactericides such as chlorinated sodium isocyanurate described in JP-A-61-120145, benzotriazoles and copper ions described in JP-A-61-267761, and bactericides described in Hiroshi Horiguchi, *Bokin, Bobai no Kagaku* (*Antibacterial and Antifungal Chemistry*), Sankyo Shuppan (1986), *Biseibutsu no Mekkin, Sakkin, Bobai Gijutsu* (*Sterilizing, Disinfecting and Fungicidal Technology for Microorganisms*), compiled by Eisei Gijutsu Kai, issued by Kogyo Gijutsu Kai (1982), and *Bokin-Bobai Zai Jiten* (*Handbook of Bactericides and Fungicides*), compiled by Nippon Bokin Bobai Gakkai (1986), can be also used.

In addition, a surfactant may be used as a water draining agent, and a chelating agent as represented by EDTA may be used as a hard water softening agent.

[Light-Sensitive Material to which Applied]

The light-sensitive material for use in the present invention is described below. As described above regarding the object of the present invention and in Background Art, the light-sensitive material for use in the present invention is a color photographic light-sensitive material for photographing generally used on the photographic market, such as color negative film, or a color light-sensitive material for print, such as color printing paper. In this light-sensitive material, at least one light-sensitive layer is provided on a support. A typical example is a silver halide photographic light-sensitive material comprising a support having thereon at least one light-sensitive layer comprising multiple silver halide emulsion layers having substantially the same color sensitivity but differing in the light sensitivity.

In a multilayer silver halide color photographic light-sensitive material for photographing, the light-sensitive layer is a unit light-sensitive layer having color sensitivity to any one of blue light, green light and red light and the unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be interposed between layers having the same color sensitivity. A light-insensitive layer may also be provided between the above-described silver halide light-sensitive layers or as an uppermost or lowermost layer. This layer may contain a coupler, a DIR compound, a color mixing inhibitor and the like which are described later. In the case where each unit light-sensitive layer is constituted by multiple silver halide emulsion layers, high-sensitivity and low-sensitivity two emulsion layers are preferably arranged such that the light sensitivity sequentially decreases toward the support as described in German Patent 1,121,470 and British Patent 923,045. It may be also possible to provide a low-sensitivity emulsion layer in the side remote from the support and provide a high-sensitivity emulsion layer in the side closer to the support as described in JP-A-57-112751, JP-A-62-200350, JP-A-62-206541 and JP-A-62-206543.

In addition, an arrangement consisting of three layers differing in the light sensitivity may be used as described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support. Even in this layer structure consisting of three layers differing in the light sensitivity, the layers having the same color sensitivity may be provided in the order of medium-sensitivity emulsion layer/high-sensitivity emulsion layer/low-sensitivity emulsion layer from the side remote from the support as described in JP-A-59-202464. Furthermore, the layers may be provided in the order of high-sensitivity emulsion layer/low-sensitivity emulsion layer/medium-sensitivity emulsion layer or low-sensitivity emulsion layer/medium-sensitivity emulsion layer/high-sensitivity emulsion layer.

In order to enhance the color reproducibility, a donor layer (CL) having an interlayer effect and differing in the spectral sensitivity distribution from the main light-sensitive layers such as BL, GL and RL described in U.S. Pat. Nos. 4,663,271, 4,705,744 and 4,707,436, JP-A-62-160448 and JP-A-63-89850 is preferably disposed adjacently to or in the proximity of the main light-sensitive layer.

In the light-sensitive material for print, a reflective support is generally used and in many cases, a red-sensitive layer, a green-sensitive layer and a blue-sensitive layer are provided in this order from the side remote from the support. As for the silver halide emulsion, a cubic emulsion comprising a silver chloride grain or a silver chlorobromide grain having a high silver chloride content is used.

The silver halide photographic emulsion which can be used in the present invention can be prepared by using the methods described, for example, in "I. Emulsion Preparation and Types" of *Research Disclosure* (hereinafter simply referred to as "RD"), No. 17643, pp. 22–23 (December, 1978), ibid., No. 18716, page 648 (November, 1979), ibid., No. 307105, pp. 863–865 (November, 1989), P. Glafkides, *Chemie et Phisique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). The monodisperse emulsions described in U.S. Pat. Nos. 3,574,628 and 3,655,394 and British Patent 1,413,748 are also preferred.

The photographic additives which can be used in the color light-sensitive material are also described in RDs and pertinent portions are shown in the Table below.

| Kinds of Additives | RD17643 | RD18716 | RD3071051. |
|---|---|---|---|
| Chemical sensitizer | p. 23 | p. 648, right col. | p. 866 |
| Sensitivity increasing agent | | p. 684, right col. | |
| Spectral sensitizer, supersensitizer | pp. 23–24 | p. 648, right col. to p. 649, right col. | pp. 866–868 |
| Brightening agent | p. 24 | p. 647, right col. | p. 868 |
| Light absorbent, filter dye, UV absorbent | pp. 25–26 | p. 649, right col. to p. 650, left col. | p. 873 |
| Binder | p. 26 | p. 651, left col. | pp. 873–874 |
| Plasticizer, lubricant | p. 27 | p. 650, right col. | p. 876 |
| Coating aid, surfactant | pp. 26–27 | p. 650, right col. | pp. 875–876 |
| Antistatic agent | p. 27 | p. 650, right col. | pp. 876–877 |
| Matting agent | | | pp. 878–879 |

As for the printer for producing a print by a development processing using the solid processing agent of the present invention, a general-purpose printer is used. In addition to a print system using a general negative printer, the present invention is suited for a scanning exposure system using a cathode ray tube (CRT). The cathode ray tube exposure apparatus is simple and compact as compared with an apparatus using a laser and the cost is low. Also, the adjustment of optical axis and colors is easy. In the cathode ray tube used for image exposure, various light emitters showing emission in the spectral region are used as needed. For example, any one of red emitter, green emitter and blue emitter is used or a mixture of two or more of these emitters are used. the spectral region is not limited to those red, green and blue regions and phosphors having emission in the yellow, orange, violet or infrared region may be also used. A cathode ray tube of emitting white light by mixing these emitters is often used.

In the case where the light-sensitive material has multiple light-sensitive layers differing in the spectral sensitivity distribution and the cathode ray tube also has phosphors showing emission in multiple spectral regions, multiple colors may be exposed all at once, that is, image signals of multiple colors may be input to the cathode ray tube and multiple colors may be emitted from the tube surface. Also, a method of sequentially inputting an image signal of each color to sequentially emit light of each color and performing the exposure through a film which cuts colors except for the color of light emitted (sequential plane exposure) may be employed. In general, sequential plane exposure is preferred for obtaining a high-quality image because a cathode ray tube having high resolving power can be used.

The light-sensitive material of the present invention is preferably used for a digital scanning exposure system using monochromatic high density light, such as gas laser, light-emitting diode, semiconductor laser and second harmonic generation light source (SHG) comprising a combination of nonlinear optical crystal with a semiconductor laser or with a solid state laser using a semiconductor laser as an excitation light source. For realizing a compact and inexpensive system, a semiconductor laser or a second harmonic generation light source (SHG) comprising a combination of nonlinear optical crystal with a semiconductor laser or with a solid state laser is preferably used. In particular, for designing a compact and inexpensive apparatus having long life and high stability, a semiconductor laser is preferred and at least one exposure light source is preferably a semiconductor laser.

In the case of using such a scanning exposure light source, the spectral sensitivity maximum wavelength of the light-sensitive material of the present invention can be arbitrarily set according to the wavelength of the scanning exposure light source used. The oscillation wavelength of a laser can be made half when using an SHG light source comprising a combination of nonlinear optical crystal with a semiconductor laser or with a solid laser using a semi-conductor laser as an excitation light source and therefore, blue light and green light can be obtained. Accordingly, the spectral sensitivity maximum of a light-sensitive material can be made to exist in normal three wavelength regions of blue, green and red. When the exposure time in such scanning exposure is defined as the time necessary for exposing a pixel size with a pixel density of 400 dpi, the exposure time is preferably $10^{-4}$ second or less, more preferably $10^{-6}$ second or less. For the purpose of inhibiting unauthorized duplication of the light-sensitive material processed according to the present invention, a latent image of a micro-dot pattern can be also formed in the light-sensitive material. The method therefor is disclosed in JP-A-9-226227.

Preferred scanning exposure systems which can be applied to the present invention are described in detail in the patents shown in the Table above. Also, in processing a light-sensitive material according to the present invention, the processing materials and processing methods described in JP-A-2-207250 (from page 26, right lower column, line 1 to page 34, right upper column, line 9) and JP-A-4-97355 (from page 5, left upper column, line 17 to page 18, right lower column line 20) can be preferably applied.

EXAMPLES

The present invention is specifically described by referring to Examples, but the present invention is not limited thereto.

Example 1-1

A solid bleach-fixing agent was prepared by using the following constituent components of the bleach-fixing agent according to the method described below.

<Bleach-Fixing Components>

| | | |
|---|---|---|
| Component A | see Table 1-1 | see Table 1-1 |
| Component B | ammonium sulfite | 500 g |
| Component C | disodium ethylenediaminetetraacetate | 100 g |
| Component D | Ammonium ferric ethylenediaminetetraacetate | 1,000 g |
| Component E | Succinic acid | 800 g |

Production of Solid Bleach-Fixing Agent:

<Production of Powder Agent>

Powder Agents 1 to 7:

The components A to E each was crushed with a commercially available hammer mill to an average particle size of 20 μm or less and crushed components A to E were thoroughly mixed. At this time, the component A was changed as shown in Table 1-1 to produce Powder Agents 1 to 7.

<Production of Granular Agent>

Granular Agents 1 to 7:

The components A to E each was crushed with a commercially available hammer mill to an average particle size of 20 μm or less and crushed components A to E were thoroughly mixed. The resulting mixture was granulated by a stirring granulator while spraying water as a binder to obtain spherical granules having an average particle size of 3 mm and the granules were dried. At this time, the component A was changed as shown in Table 1-1 to produce granular Agents 1 to 7.

Granular Agents 8 to 11:

Granular Agent Samples 8 to 11 containing the compound of formula (Ia) and a silver complex salt thereof were produced in the same manner as Samples 4 to 7 except that in the production of Granular Agent Samples 4 to 7, the component B was changed to a mixture of the component B and a silver complex salt thereof as shown in Table 1-2.

<Evaluation Test>

The thus-produced samples of powder agent and granular agent each was weighed 1 kg in a beaker and in the open state, left standing in a chamber at a temperature of 40° C. and a relative humidity of 90% for four weeks. The change in the shape of each sample (consolidating property) was evaluated. Then, each sample was dissolved in 5 liter of water and the presence or absence of insoluble matters was confirmed with an eye. The test results are shown in Table 1-1.

TABLE 1-1

| Test No. | Solid Processing Agent | Component A | Amount Added | Change in Shape (consolidating property) | Insoluble Matters | Remarks |
|---|---|---|---|---|---|---|
| 1 | Powder 1 | ammonium thiosulfate | 1000 g | liquefaction was generated | present | Comparison |
| 2 | Powder 2 | sodium thiosulfate | 1000 g | liquefaction was generated | present | Comparison |
| 3 | Powder 3 | potassium thiocyanate | 1000 g | strong consolidation; flowability was not recovered even when strong impact was applied 20 times | none | Comparison |
| 4 | Powder 4 | Ia-1 | 1000 g | light consolidation; flowability was recovered when light impact was applied 5 times | none | Invention |

TABLE 1-1-continued

| Test No. | Solid Processing Agent | Component A | Amount Added | Change in Shape (consolidating property) | Insoluble Matters | Remarks |
|---|---|---|---|---|---|---|
| 5 | Powder 5 | Ia-2 | 1000 g | light consolidation; flowability was recovered when light impact was applied 6 times | none | Invention |
| 6 | Powder 6 | Ia-4 | 1000 g | light consolidation; flowability was recovered when light impact was applied 6 times | none | Invention |
| 7 | Powder 7 | Ia-6 | 1000 g | light consolidation; flowability was recovered when light impact was applied 5 times | none | Invention |
| 8 | Granular 1 | ammonium thiosulfate | 1000 g | liquefaction was generated | present | Comparison |
| 9 | Granular 2 | sodium thiosulfate | 1000 g | liquefaction was generated | present | Comparison |
| 10 | Granular 3 | potassium thiocyanate | 1000 g | strong consolidation; flowability was not recovered even when strong impact was applied 20 times | none | Comparison |
| 11 | Granular 4 | Ia-1 | 1000 g | light consolidation; flowability was recovered when light impact was applied 2 times | none | Invention |
| 12 | Granular 5 | Ia-2 | 1000 g | light consolidation; flowability was recovered when light impact was applied 3 times | none | Invention |
| 13 | Granular 6 | Ia-4 | 1000 g | light consolidation; flowability was recovered when light impact was applied 3 times | none | Invention |
| 14 | Granular 7 | Ia-6 | 1000 g | light consolidation; flowability was recovered when light impact was applied 2 times | none | Invention |
| 15 | Granular 8 | Ia-1<br>Ag complex salt of Ia-1 | 1000 g<br>20 g | not consolidated at all | none | Invention |
| 16 | Granular 9 | Ia-2<br>Ag complex salt of Ia-2 | 1000 g<br>20 g | not consolidated at all | none | Invention |
| 17 | Granular 10 | Ia-4<br>Ag complex salt of Ia-4 | 1000 g<br>20 g | not consolidated at all | none | Invention |
| 18 | Granular 11 | Ia-6<br>Ag complex salt of Ia-6 | 1000 g<br>20 g | not consolidated at all | none | Invention |

As seen from the results in Table 1-1, in the powder agents and granular agents containing the compound of formula (I) of the present invention, excellent results were obtained, that is, consolidation of solids with each other was remarkably prevented and generation of insoluble matters was not observed at all.

Out of the samples of the present invention, the consolidation was less generated in granular agents than in powder agents. Also, in Granular Agent Samples 8 to 11 containing the compound of formula (I) of the present invention and a silver complex salt thereof, consolidation was not generated at all and more excellent results were obtained.

Example 1-2

A solid bleach-fixing agent was prepared by using the following constituent components of the bleach-fixing agent according to the method described below.

<Bleach-Fixing Components>

| | | |
|---|---|---|
| Component A | ammonium sulfite | 500 g |
| Component B | see Table 1-2 | see Table 1-2 |
| Component C | disodium ethylenediaminetetraacetate | 100 g |
| Component D | Ammonium ferric ethylenediaminetetraacetate | 1,000 g |
| Component E | Succinic acid | 800 g |

<Production of Granular Agent>

Granular Agents 1 to 7:

The component A was formed into an amorphous granulated product having an average particle size of 1 mm by a compression granulator (roller compactor). Then, the components B to E each was crushed with a commercially available hammer mill to an average particle size of 20 μm or less.

Using the granulated product of component A as the inner core, the component B was added on the inner core surface by a centrifugal flow-type coating granulator while spraying water as a binder to form a coating layer. Thereafter, the coating layers of components C, D and E were sequentially formed on the granulated product surface in the same manner. Granular Agents 1 to 7 were produced by changing the component B as shown in Table 1-2.

Granular Agents 8 to 11:

Samples 8 to 11 containing the compound of formula (Ia) and a silver complex salt thereof were produced in the same manner as Samples 4 to 7 except that in the production of Samples 4 to 7, the component B was changed to a mixture of the component B and a silver complex salt thereof as shown in Table 1-2.

<Evaluation Test>

In the same manner as in Example 1-1, the samples of granular agent each was weighed 1 kg in a beaker and in the open state, left standing in a chamber at a temperature of 40° C. and a relative humidity of 90% for four weeks. The change in the shape of each sample (consolidating property)

was evaluated. Then, each sample was dissolved in 5 liter of water and the presence or absence of insoluble matters was confirmed with an eye. The test results are shown in Table 1-2.

TABLE 1-2

| Test No. | Solid Processing Agent | Component B | Amount Added | Change in Shape (consolidating property) | Insoluble Matters | Remarks |
|---|---|---|---|---|---|---|
| 1 | Granular 1 | ammonium thiosulfate | 1000 g | strong consolidation; flowability was not recovered even when strong impact was applied 20 times | present | Comparison |
| 2 | Granular 2 | sodium thiosulfate | 1000 g | strong consolidation; flowability was not recovered even when strong impact was applied 20 times | present | Comparison |
| 3 | Granular 3 | potassium thiocyanate | 1000 g | strong consolidation; flowability was not recovered even when strong impact was applied 20 times | none | Comparison |
| 4 | Granular 4 | Ia-1 | 1000 g | light consolidation; flowability was recovered when light impact was applied once | none | Invention |
| 5 | Granular 5 | Ia-2 | 1000 g | light consolidation; flowability was recovered when light impact was applied once | none | Invention |
| 6 | Granular 6 | Ia-4 | 1000 g | light consolidation; flowability was recovered when light impact was applied once | none | Invention |
| 7 | Granular 7 | Ia-6 | 1000 g | light consolidation; flowability was recovered when light impact was applied once | none | Invention |
| 8 | Granular 8 | Ia-1<br>Ag complex salt of Ia-1 | 1000 g<br>20 g | not consolidated at all | none | Invention |
| 9 | Granular 9 | Ia-2<br>Ag complex salt of Ia-2 | 1000 g<br>20 g | not consolidated at all | none | Invention |
| 10 | Granular 10 | Ia-4<br>Ag complex salt of Ia-4 | 1000 g<br>20 g | not consolidated at all | none | Invention |
| 11 | Granular 11 | Ia-6<br>Ag complex salt of Ia-6 | 1000 g<br>20 g | not consolidated at all | none | Invention |

As seen from the results in Table 1-2, in the granular agents containing the compound of formula (I) of the present invention, excellent results were obtained, that is, consolidation of granules with each other was remarkably prevented and generation of insoluble matters was not observed at all.

Out of the samples of the present invention, in Samples 8 to 11 containing the compound of formula (I) of the present invention and a silver complex salt thereof, consolidation was not generated at all and more excellent results were obtained.

Example 1-3

A solid bleach-fixing agent was prepared by using the following constituent components of the bleach-fixing agent according to the method described below.

<Bleach-Fixing Components>

| | | |
|---|---|---|
| Component A | ammonium sulfite | 500 g |
| Component B | see Table 1-3 | see Table 1-3 |
| Component C | disodium ethylenediaminetetraacetate | 100 g |
| Component D | Ammonium ferric ethylenediaminetetraacetate | 1,000 g |
| Component E | Succinic acid | 800 g |

<Production of Granular Agent>

Tablet Agents 1 to 7:

The components A to E each was crushed with a commercially available hammer mill to an average particle size of 20 μm or less. The crushed components each was formed into granules having an average particle size of 0.5 mm by a fluidized bed spray granulator.

The granular components A to E were mixed and after adding 3 g of N-lauroylalanine sodium, further thoroughly mixed.

The obtained mixture was compression-tableted in an amount of 10 g per tablet by a tableting machine to produce Tablet Agents 1 to 7.

Granular Agents 8 to 11:

Tablet Agent Samples 8 to 11 containing the compound of formula (Ia) and a silver complex salt thereof were produced in the same manner as Tablet Agent Samples 4 to 7 except that in the production of Tablet Agent Samples 4 to 7, the component B was changed to a mixture of the component B and a silver complex salt thereof as shown in Table 1-2.

<Evaluation Test>

In the same manner as in Example 1-1, the samples of tablet agent each was weighed 1 kg in a beaker and in the open state, left standing in a chamber at a temperature of 40° C. and a relative humidity of 90%. The change in the shape of each sample (consolidating property) was evaluated. Then, each sample was dissolved in 5 liter of water and the presence or absence of insoluble matters was confirmed with an eye. The test results are shown in Table 1-3.

TABLE 1-3

| Test No. | Solid Processing Agent | Component B | Amount Added | Change in Shape (consolidating property) | Insoluble Matters | Remarks |
|---|---|---|---|---|---|---|
| 1 | Tablet 1 | ammonium thiosulfate | 1000 g | liquefaction was generated | present | Comparison |
| 2 | Tablet 2 | sodium thiosulfate | 1000 g | liquefaction was generated | present | Comparison |
| 3 | Tablet 3 | potassium thiocyanate | 1000 g | strong consolidation; flowability was not recovered even when strong impact was applied 20 times | none | Comparison |
| 4 | Tablet 4 | Ia-1 | 1000 g | light consolidation; flowability was recovered when light impact was applied once | none | Invention |
| 5 | Tablet 5 | Ia-2 | 1000 g | light consolidation; flowability was recovered when light impact was applied once | none | Invention |
| 6 | Tablet 6 | Ia-4 | 1000 g | light consolidation; flowability was recovered when light impact was applied once | none | Invention |
| 7 | Tablet 7 | Ia-6 | 1000 g | light consolidation; flowability was recovered when light impact was applied once | none | Invention |
| 8 | Tablet 8 | Ia-1<br>Ag complex salt of Ia-1 | 1000 g<br>20 g | not consolidated at all | none | Invention |
| 9 | Tablet 9 | Ia-2<br>Ag complex salt of Ia-2 | 1000 g<br>20 g | not consolidated at all | none | Invention |
| 10 | Tablet 10 | Ia-4<br>Ag complex salt of Ia-4 | 1000 g<br>20 g | not consolidated at all | none | Invention |
| 11 | Tablet 11 | Ia-6<br>Ag complex salt of Ia-6 | 1000 g<br>20 g | not consolidated at all | none | Invention |

As seen from the results in Table 1-3, in the tablet agents containing the compound of formula (I) of the present invention, excellent results were obtained, that is, consolidation of tablets with each other was remarkably prevented and generation of insoluble matters was not observed at all.

Out of the samples of the present invention, in the case of containing the compound of formula (I) of the present invention and a silver complex salt thereof (Samples 8 to 11), consolidation was not generated at all and more excellent results were obtained.

Example 2-1

(Preparation of Blue-Sensitive Layer Emulsion BH-1)

A high silver chloride cubic grain was prepared by a method of simultaneously adding silver nitrate and sodium chloride to deionized gelatin-containing deionized distilled water under stirring and mixing these. In the process of this preparation, $Cs_2[OsCl_5(NO)]$ was added between the point when 60% of silver nitrate was added and the point when 80% of silver nitrate was added, potassium bromide (1.5 mol % per mol of finished silver halide) and $K_4[Fe(CN)_6]$ were added between the point when 80% of silver nitrate was added and the point when 90% of silver nitrate was added, $K_2[IrCl_6]$ was added between the point when 83% of silver nitrate was added and the point when 88% of silver nitrate was added, $K_2[IrCl_5(H_2O)]$ and $K[IrCl_4(H_2O)_2]$ were added between the point when 92% of silver nitrate was added and the point when 98% of silver nitrate was added, and potassium iodide (0.27 mol % per mol of finished silver halide) was added with vigorous stirring at the point when 94% of silver nitrate addition was completed. The obtained emulsion grain was a monodisperse cubic silver iodobromochloride grain having a side length of 0.54 μm and a coefficient of variation of 8.5%. This emulsion was subjected to desilvering by flocculation and then redispersed by adding gelatin, Compounds Ab-1, Ab-2 and Ab-3, and calcium nitrate.

Antiseptic (Ab-1):

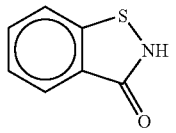

Antiseptic (Ab-2):

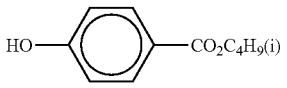

Antiseptic (Ab-3):

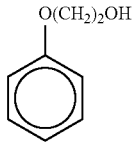

The redispersed emulsion was dissolved at 40° C. and thereto Sensitizing Dyes S-1, S-2 and S-3 of the present invention were added to effect optimal spectral sensitization. Subsequently, sodium benzenethiosulfate, triethylthiourea as a sulfur sensitizer, and Compound 1 as a gold sensitizer were added and then the emulsion was ripened to effect optimal chemical sensitization. Thereafter, 1-(5-methylureidophenyl)-5-mercaptotetrazole, Compound 2, Compound 3 which is a compound comprising 2 or 3 repeating units as the main component (terminals X1 and X3 are a hydroxyl group), Compound 4 and potassium bromide were added, thereby completing the chemical sensitization. The thus-obtained emulsion was designated as Emulsion BH-1.

Sensitizing Dye S-1:

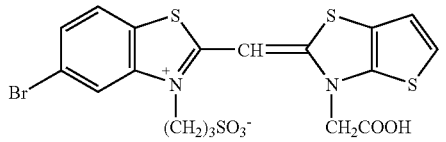

Sensitizing Dye S-2:

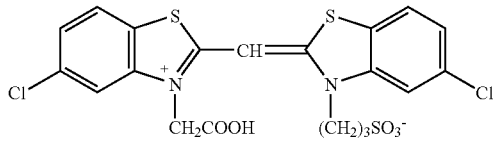

Sensitizing Dye S-3:

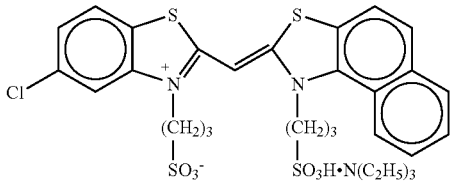

Compound 1:

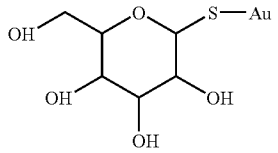

Compound 2:

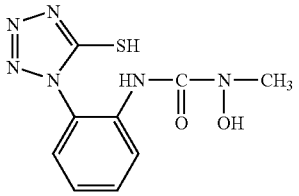

Compound 3:

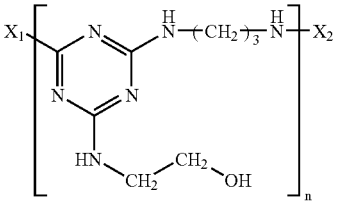

Compound 4:

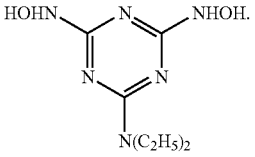

(Preparation of Blue-Sensitive Layer Emulsion BL-1)

An emulsion grain was obtained in the same manner as in the preparation of Emulsion BH-1 except that the temperature and addition rate in the step of simultaneously adding and mixing silver nitrate and sodium chloride were changed and the amounts of various metal complexes added on the way of the addition of silver nitrate and sodium chloride were changed. The obtained emulsion grain was a monodisperse cubic silver iodobromochloride grain having a side length of 0.44 μm and a coefficient of variation of 9.5%. After redispersing this emulsion, Emulsion BL-1 was prepared in the same manner except for changing the amounts of various compounds added from those of BH-1.

(Preparation of Green-Sensitive Layer Emulsion GH-1)

A high silver chloride cubic grain was prepared by a method of simultaneously adding silver nitrate and sodium chloride to deionized gelatin-containing deionized distilled water under stirring and mixing these. In the process of this preparation, $K_4[Ru(CN)_6]$ was added between the point when 80% of silver nitrate was added and the point when 90% of silver nitrate was added, potassium bromide (2 mol % per mol of finished silver halide) was added between the point when 80% of silver nitrate was added and the point when 100% of silver nitrate was added, $K_2[IrCl_6]$ and $K_2[RhBr_5(H_2O)]$ were added between the point when 83% of silver nitrate was added and the point when 88% of silver nitrate was added, potassium iodide (0.1 mol % per mol of finished silver halide) was added with vigorous stirring at the point when 90% of silver nitrate addition was completed, and $K_2[IrCl_5(H_2O)]$ and $K[IrCl_4(H_2O)_2]$ were added between the point when 92% of silver nitrate was added and the point when 98% of silver nitrate was added. The obtained emulsion grain was a monodisperse cubic silver iodobromochloride grain having a side length of 0.42 μm and a coefficient of variation of 8.0%. This emulsion was subjected to desilvering by flocculation and redispersion in the same manner as above.

The obtained emulsion was dissolved at 40° C. and thereto sodium benzenethiosulfate, p-glutaramidophenyl disulfide, sodium thiosulfate pentahydrate as a sulfur sensitizer, and bis(1,4,5-trimethyl-1,2,4-triazolium-3-thiolato) gold(I) tetrafluoroborate as a gold sensitizer were added to effect optimal chemical sensitization. Subsequently, 1-(3-acetamidophenyl)-5-mercaptotetrazole, 1-(5-methylureidophenyl)-5-mercaptotetrazole, Compound 2, Compound 4 and potassium bromide were added. Furthermore, Sensitizing Dyes S-4, S-5, S-6 and S-7 were added on the way of the emulsion preparation step to effect spectral sensitization. The thus-obtained emulsion was designated as Emulsion GH-1.

Sensitizing Dye S-4:

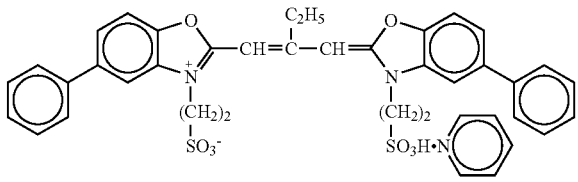

Sensitizing Dye S-5:

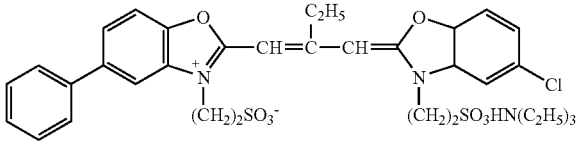

-continued

Sensitizing Dye S-6:

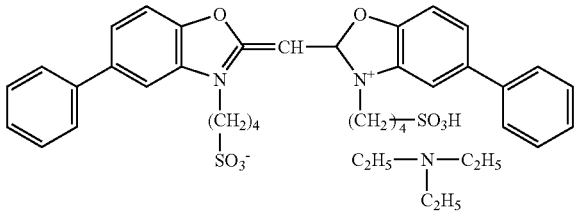

Sensitizing Dye S-7:

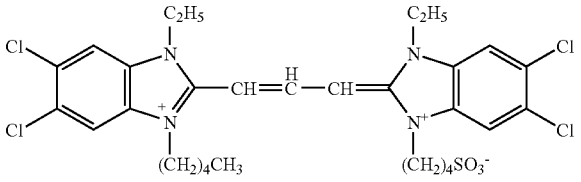

(Preparation of Green-Sensitive Layer Emulsion GL-1)

An emulsion grain was obtained in the same manner as in the preparation of Emulsion GH-1 except that the temperature and addition rate in the step of simultaneously adding and mixing silver nitrate and sodium chloride were changed and the amounts of various metal complexes added on the way of the addition of silver nitrate and sodium chloride were changed. The obtained emulsion grain was a monodisperse cubic silver iodobromochloride grain having a side length of 0.35 μm and a coefficient of variation of 9.8%. After redispersing this emulsion, Emulsion GL-1 was prepared in the same manner except for changing the amounts of various compounds added from those of GH-1.

(Preparation of Red-Sensitive Layer Emulsion RH-1)

A high silver chloride cubic grain was prepared by a method of simultaneously adding silver nitrate and sodium chloride to deionized gelatin-containing deionized distilled water under stirring and mixing these. In the process of this preparation, $Cs_2[OsCl_5(NO)]$ was added between the point when 60% of silver nitrate was added and the point when 80% of silver nitrate was added, $K_4[Ru(CN)_6]$ was added between the point when 80% of silver nitrate was added and the point when 90% of silver nitrate was added, potassium bromide (1.3 mol % per mol of finished silver halide) was added between the point when 80% of silver nitrate was added and the point when 100% of silver nitrate was added, $K_2[IrCl_5$ (5-methylthiazole)] was added between the point when 83% of silver nitrate was added and the point when 88% of silver nitrate was added, potassium iodide (in an amount of giving a silver iodide amount of 0.05 mol % per mol of finished silver halide) was added with vigorous stirring at the point when 88% of silver nitrate addition was completed, and $K_2[IrCl_5(H_2O)]$ and $K[IrCl_4(H_2O)_2]$ were added between the point when 92% of silver nitrate was added and the point when 98% of silver nitrate was added. The obtained emulsion grain was a monodisperse cubic silver iodobromochloride grain having a cube side length of 0.39 μm and a coefficient of variation of 10%. This emulsion was subjected to desilvering by flocculation and redispersion in the same manner as above.

The obtained emulsion was dissolved at 40° C. and thereto Sensitizing Dye S-8, Compound 5, triethylthiourea as a sulfur sensitizer, and Compound 1 as a gold sensitizer were added. Then, the emulsion was ripened to effect optimal chemical sensitization. Subsequently, 1-(3-acetamidophenyl)-5-mercaptotetrazole, 1-(5-methylureidophenyl)-5-mercaptotetrazole, Compound 2, Compound 4 and potassium bromide were added. The thus-obtained emulsion was designated as Emulsion RH-1.

Sensitizing Dye S-8:

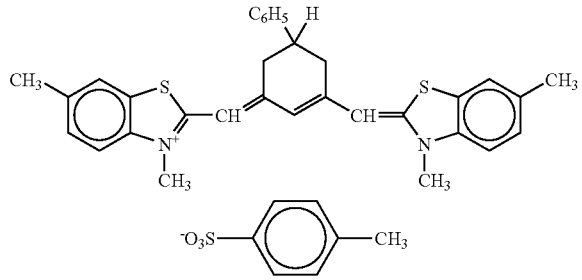

Compound 5:

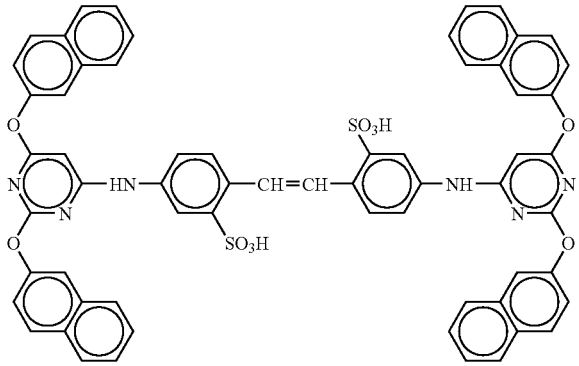

(Preparation of Red-Sensitive Layer Emulsion RL-1)

An emulsion grain was obtained in the same manner as in the preparation of Emulsion RH-1 except that the temperature and addition rate in the step of simultaneously adding and mixing silver nitrate and sodium chloride were changed and the amounts of various metal complexes added on the way of the addition of silver nitrate and sodium chloride were changed. The obtained emulsion grain was a monodisperse cubic silver iodobromochloride grain having a side length of 0.29 μm and a coefficient of variation of 9.9%. After desilvering by flocculation and redispersing this emulsion, Emulsion RL-1 was prepared in the same manner except for changing the amounts of various compounds added from those of RH-1.

Preparation of Coating Solution for First Layer:

Yellow Coupler (ExY-1) (34 g), 1 g of Dye Stabilizer (Cpd-1), 1 g of Dye Stabilizer (Cpd-2), 8 g of Dye Stabilizer (Cpd-8), 1 g of Dye Stabilizer (Cpd-18), 2 g of Dye Stabilizer (Cpd-19), 15 g of Dye Stabilizer (Cpd-20), 1 g of Dye Stabilizer (Cpd-21), 15 g of Dye Stabilizer (Cpds-23), 0.1 g of Additive (ExC-1) and 1 g of Dye Stabilizer (UV-2) were dissolved in 23 g of Solvent (Solv-4), 4 g of Solvent (Solv-6), 23 g of Solvent (Solv-9) and 60 ml of ethyl acetate. The resulting solution was emulsion-dispersed in 270 g of an aqueous 20 mass % gelatin solution containing 4 g of sodium dodecylbenzenesulfonate by a high-speed stirring emulsifier (dissolver) and thereto, water was added to prepare 900 g of Emulsified Dispersion A.

Emulsified Dispersion A was mixed with Emulsions BH-1 and BL-1 and dissolved to prepare a coating solution for the first layer having a composition shown later. The amount of emulsion coated is a coated amount in terms of silver.

Coating solutions for the second to seventh layers were prepared in the same manner as the coating solution for the first layer. In each layer, 1-oxy-3,5-dichloro-s-triazine sodium salts (H-1), (H-2) and (H-3) were used as the gelatin hardening agent. Also, in each layer, Ab-1, Ab-2 and Ab-3 were added each to give a total amount of 15.0 mg/m$^2$, 60.0 mg/M$^2$, 5.0 mg/M$^2$ or 10.0 mg/m$^2$.

Hardening Agent (H-1):

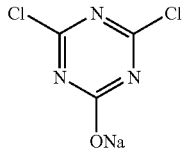

Hardening Agent (H-2):

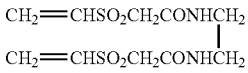

Hardening Agent (H-3):

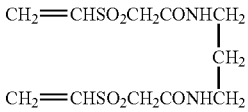

Furthermore, 1-(3-methylureidophenyl)-5-mercaptotetrazole was added to the second layer, the fourth layer and the sixth layer to give a coverage of 0.2 mg/M$^2$, 0.2 mg/m$^2$ and 0.6 mg/M$^2$, respectively. Also, 4-hydroxy-6-methyl-1,3,3a,7-tetrrazaindene was added to the blue-sensitive emulsion layer and the green-sensitive emulsion layer in an amount of $1\times10^{-4}$ mol and $2\times10^{-4}$ mol, respectively, per mol of silver halide. In the red-sensitive emulsion layer, a copolymer latex of methacrylic acid and butyl acrylate (weight ratio: 1:1, average molecular weight: 200,000 to 400,000) was added in an amount of 0.05 g/m$^2$. In addition, disodium catechol-3,5-disulfonate was added to the second layer, the fourth layer and the sixth layer to give a coverage of 6 mg/m$^2$, 6 mg/M$^2$ and 18 mg/m$^2$, respectively. For the purpose of preventing irradiation, the dyes shown below (in the parenthesis, the amount coated is shown) were added.

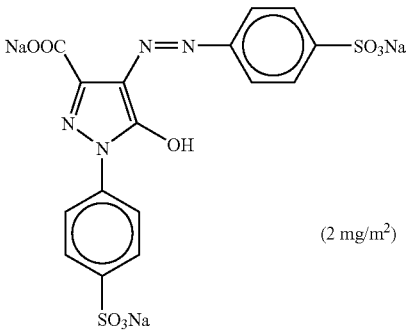

(2 mg/m$^2$)

-continued

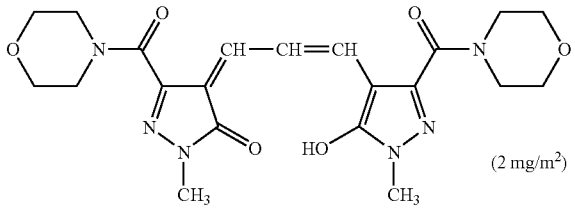

(2 mg/m$^2$)

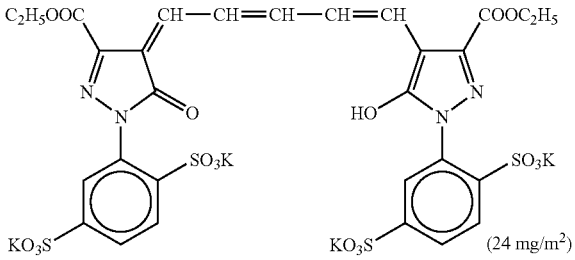

(24 mg/m$^2$)

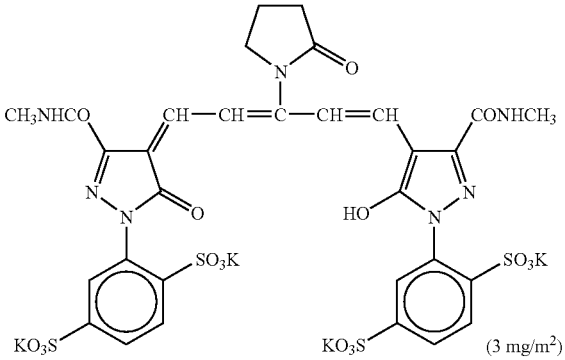

(3 mg/m$^2$)

(Layer Structure)

The constitution of each layer is shown below. The numeral shows the coated amount (g/m$^2$). In the case of silver halide emulsion, a coated amount in terms of silver is shown.

Support:

Polyethylene Resin-Laminated Paper

[the polyethylene resin in the first layer side was containing white pigments ($TiO_2$ (content: 16 wt %) and ZnO (content: 4 wt %)), a fluorescent brightening agent (4,4'-bis (5-methylbenzoxazolyl)stilbene, content: 0.03 wt %) and a bluish dye (ultramarine, content: 0.33 wt %); the amount of polyethylene resin was 29.2 g/m$^2$]

First Layer (blue-sensitive emulsion layer):

| | |
|---|---|
| Emulsion (a 5:5 mixture (by mol as silver) of BH-1 and BL-1) | 0.16 |
| Gelatin | 1.32 |
| Yellow Coupler (Ex-Y) | 0.34 |
| Dye Image Stabilizer (Cpd-1) | 0.01 |
| Dye Image Stabilizer (Cpd-2) | 0.01 |
| Dye Image Stabilizer (Cpd-8) | 0.08 |
| Dye Image Stabilizer (Cpd-18) | 0.01 |
| Dye Image Stabilizer (Cpd-19) | 0.02 |
| Dye Image Stabilizer (Cpd-20) | 0.15 |
| Dye Image Stabilizer (Cpd-21) | 0.01 |
| Dye Image Stabilizer (Cpd-23) | 0.15 |
| Additive (ExC-1) | 0.001 |
| Dye Image Stabilizer (UV-A) | 0.01 |
| Solvent (Solv-4) | 0.23 |
| Solvent (Solv-6) | 0.04 |

-continued

| | |
|---|---|
| Solvent (Solv-9) | 0.23 |
| Second Layer (color mixing inhibiting layer): | |
| Gelatin | 0.78 |
| Color Mixing Inhibitor (Cpd-4) | 0.05 |
| Color Mixing Inhibitor (Cpd-12) | 0.01 |
| Dye Image Stabilizer (Cpd-5) | 0.006 |
| Dye Image Stabilizer (Cpd-6) | 0.05 |
| Dye Image Stabilizer (UV-A) | 0.06 |
| Dye Image Stabilizer (Cpd-7) | 0.006 |
| Antiseptic (Cpd-24) | 0.006 |
| Solvent (Solv-1) | 0.06 |
| Solvent (Solv-2) | 0.06 |
| Solvent (Solv-5) | 0.07 |
| Solvent (Solv-8) | 0.07 |
| Third Layer (green-sensitive emulsion layer): | |
| Emulsion (a 1:3 mixture (by mol as silver) of GH-1 and GL-1) | 0.12 |
| Gelatin | 0.95 |
| Magenta Coupler (ExM) | 0.12 |
| Ultraviolet Absorbent (UV-A) | 0.03 |
| Dye Image Stabilizer (Cpd-2) | 0.01 |
| Dye Image Stabilizer (Cpd-6) | 0.08 |
| Dye Image Stabilizer (Cpd-7) | 0.005 |
| Dye Image Stabilizer (Cpd-8) | 0.01 |
| Dye Image Stabilizer (Cpd-9) | 0.01 |
| Dye Image Stabilizer (Cpd-10) | 0.005 |
| Dye Image Stabilizer (Cpd-11) | 0.0001 |
| Dye Image Stabilizer (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth Layer (color mixing inhibiting layer): | |
| Gelatin | 0.65 |
| Color Mixing Inhibitor (Cpd-4) | 0.04 |
| Color Mixing Inhibitor (Cpd-12) | 0.01 |
| Dye Image Stabilizer (Cpd-5) | 0.005 |
| Dye Image Stabilizer (Cpd-6) | 0.04 |
| Dye Image Stabilizer (UV-A) | 0.05 |
| Dye Image Stabilizer (Cpd-7) | 0.005 |
| Antiseptic (Cpd-24) | 0.005 |
| Solvent (Solv-1) | 0.05 |
| Solvent (Solv-2) | 0.05 |
| Solvent (Solv-5) | 0.06 |
| Solvent (Solv-8) | 0.06 |
| Fifth Layer (red-sensitive emulsion layer): | |
| Emulsion (a 4:6 mixture (by mol as silver) of RH-1 and RL-1) | 0.10 |
| Gelatin | 1.11 |
| Cyan Coupler (ExC-1) | 0.11 |
| Cyan Coupler (ExC-2) | 0.01 |
| Cyan Coupler (ExC-3) | 0.04 |
| Dye Image Stabilizer (Cpd-1) | 0.03 |
| Dye Image Stabilizer (Cpd-7) | 0.01 |
| Dye Image Stabilizer (Cpd-9) | 0.04 |
| Dye Image Stabilizer (Cpd-10) | 0.001 |
| Dye Image Stabilizer (Cpd-14) | 0.001 |
| Dye Image Stabilizer (Cpd-15) | 0.18 |
| Dye Image Stabilizer (Cpd-16) | 0.002 |
| Dye Image Stabilizer (Cpd-17) | 0.001 |
| Dye Image Stabilizer (Cpd-18) | 0.05 |
| Dye Image Stabilizer (Cpd-19) | 0.04 |
| Dye Image Stabilizer (UV-5) | 0.10 |
| Solvent (Solv-5) | 0.19 |
| Sixth Layer (ultraviolet absorbing layer): | |
| Gelatin | 0.34 |
| Ultraviolet Absorbent (UV-B) | 0.24 |
| Compound (S1-4) | 0.0015 |
| Solvent (Solv-7) | 0.11 |
| Seventh Layer (protective layer): | |
| Gelatin | 0.82 |
| Additive (Cpd-22) | 0.03 |
| Liquid paraffin | 0.02 |

-continued

| | |
|---|---|
| Surfactant (Cpd-13) | 0.02 |

(Ex-Y):

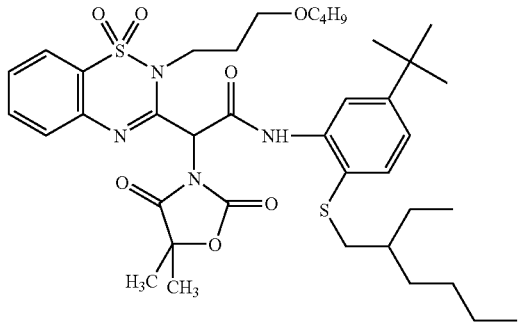

Magenta Coupler (ExM):

A 40:40:20 mixture (by mol) of

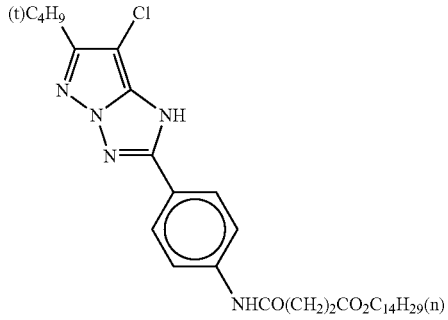

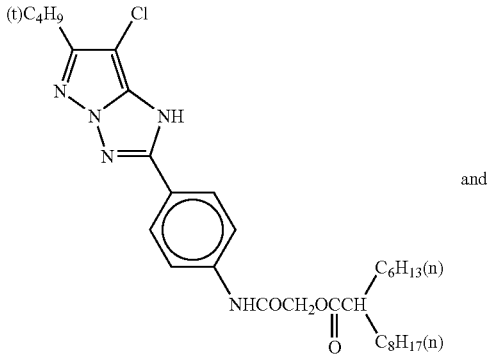

and

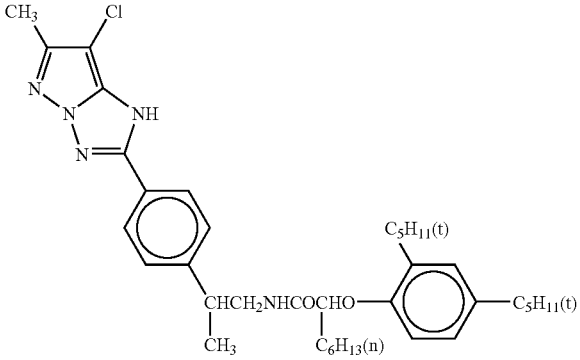

-continued

Cyan Coupler (ExC-1):

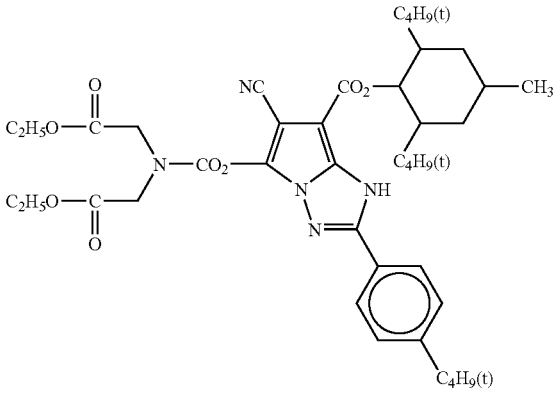

Cyan Coupler (ExC-2):

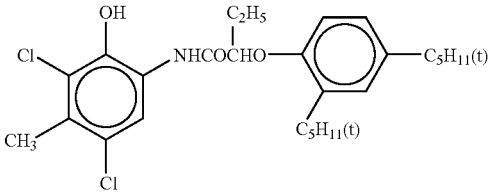

Cyan Coupler (ExC-3):

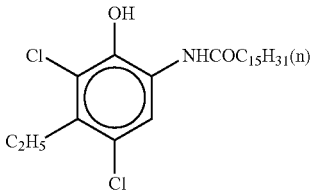

Dye Image Stabilizer (Cpd-1):

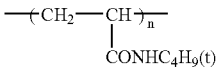

Number average molecular weight: 60,000

Dye Image Stabilizer (Cpd-2):

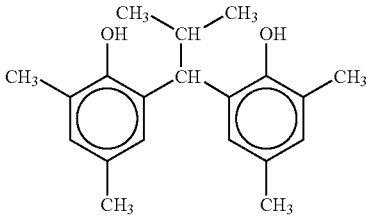

Dye Image Stabilizer (Cpd-3):

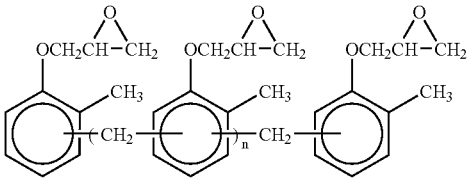

n: from 7 to 8 (average)

-continued

Color Mixing Inhibitor (Cpd-4):

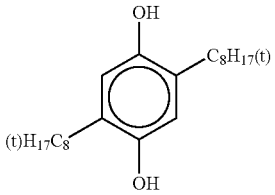

Dye Image Stabilizer (Cpd-5):

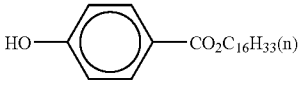

Dye Image Stabilizer (Cpd-6):

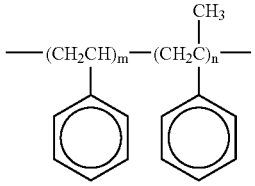

Number average molecular weight: 600 m/n = 10/90

Dye Image Stabilizer (Cpd-7):

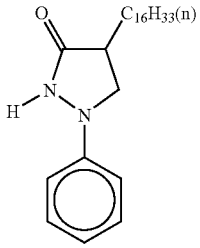

Dye Image Stabilizer (Cpd-8):

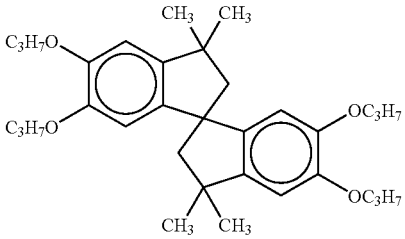

Dye Image Stabilizer (Cpd-9):

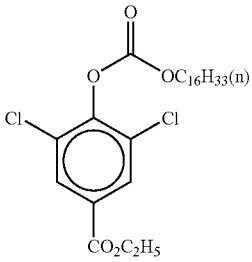

Dye Image Stabilizer (Cpd-10):

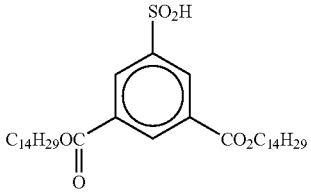

-continued
(Cpd-11):
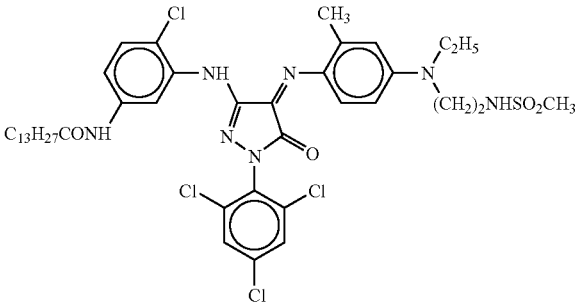
(Cpd-12):
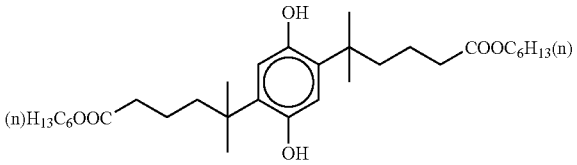
(Cpd-13): Surfactant
A 6:2:2 (by mol) mixture of (a)/(b)/(c)
(a)
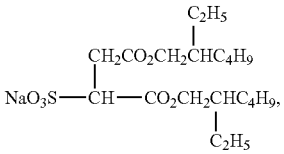
(b)
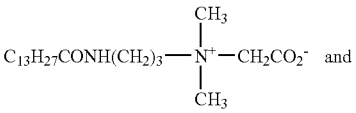
and
(c)
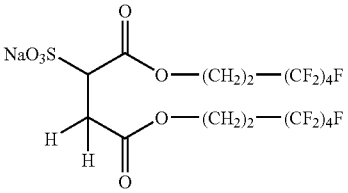
-continued
(Cpd-14):
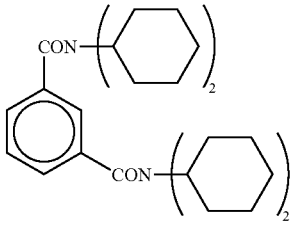
(Cpd-15):
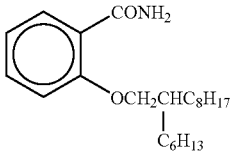
(Cpd-16):
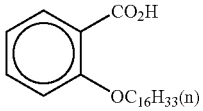
(Cpd-17):
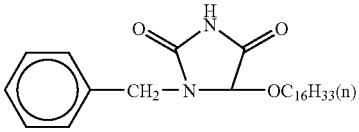
(Cpd-18):
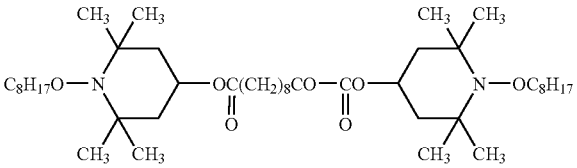
(Cpd-19):
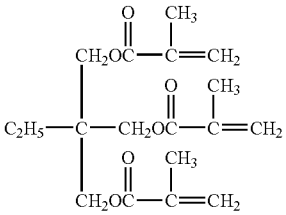

-continued
(Cpd-20):
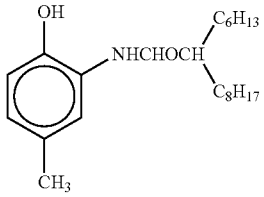
(Cpd-21):
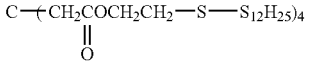
(Cpd-22):
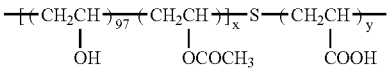
x:y = 5:1 (by mass)
(Cpd-23):
KAYARAD DPCA-30, produced by Nippon Kayaku Co., Ltd.
(Cpd-24):
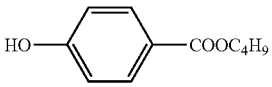
(Solv-1)
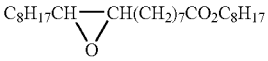
(Solv-2)
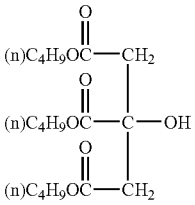
(Solv-3)
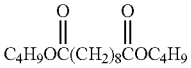
(Solv-4)
(Solv-5)
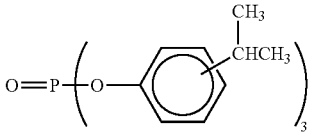
(Solv-6)
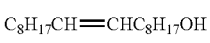
(Solv-7)
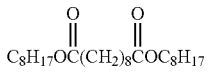
(Solv-8)
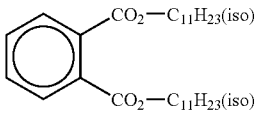
-continued
(Solv-9)
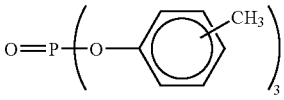
(S1-4)
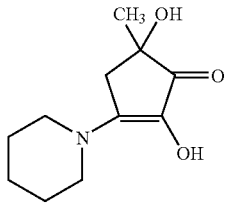
Ultraviolet Absorbent (UV-1):
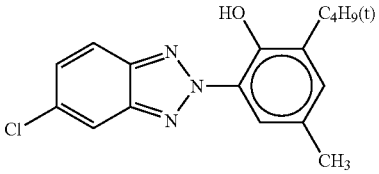
Ultraviolet Absorbent (UV-2):
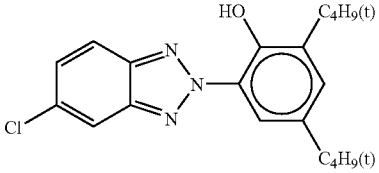
Ultraviolet Absorbent (UV-3):
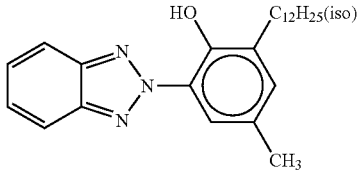
Ultraviolet Absorbent (UV-4):
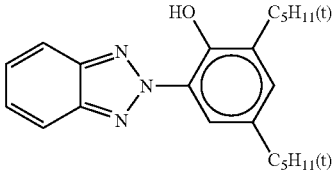
Ultraviolet Absorbent (UV-5):
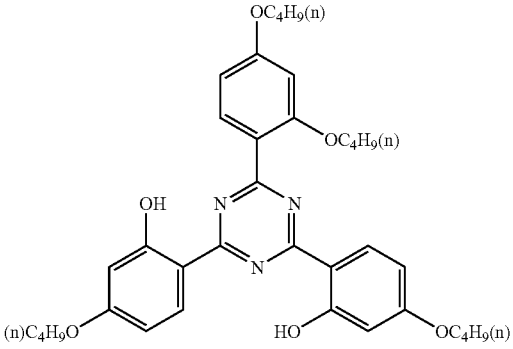

UV-A:

A 1/7/2 (by mass) mixture of UV-1/UV-4/UV-5

UV-B:

A 1/3/5/1 (by mass) mixture of UV-1/UV-3/UV-4/UV-5

The thus-prepared sample was designated as Sample 001.

Sample 001 was worked into a 127 mm-width roll and a standard photographic image was exposed by using digital mini-lab Frontier 340 (manufactured by Fuji Photo Film Co., Ltd.). Thereafter, the sample was subjected to a continuous processing (running test) through the following processing steps until the volume of color development replenisher became 2 times the volume of color development tank. Here, Frontier 340 (manufactured by Fuji Photo Film Co., Ltd.) was modified such that the transportation speed in the processor gave the following processing time by replenishing a granular agent and water to the bleach-fixing bath. The replenishment to the bleach-fixing bath was in a system of reusing a part of the overflow solution of the bleach-fixing solution according to the following method. The continuous processing was performed by changing the regeneration ratio of the overflow solution. The composition of the regenerated granular replenishing agent in each regeneration ratio is shown in Table 2-1.

<Procedure of Reuse>

1) A part of the overflow solution of the bleach-fixing solution was extracted.

2) By using an electrolytic silver recovery apparatus (BF-12, manufactured by Matsuda Kagaku K.K.), silver was recovered from the overflow solution to reduce the silver concentration in the overflow solution to about 1 g/liter.

3) The resulting overflow solution was concentrated and dried up by using a thin film-type flash evaporator (MF-10A, manufactured by Tokyo Rika K.K.) and the evaporated and recovered water was collected.

4) A regenerant was added to the dried-up product of the overflow solution to obtain a regenerated granular replenishing agent.

5) The regenerated granular replenishing agent and the evaporated and recovered water were separately replenished.

| Processing Step | Temperature (° C.) | Time (sec) | Replenishing Amount |
|---|---|---|---|
| Color development | 45.0 | 15 | 45 ml |
| Bleach-fixing | 40.0 | 15 | granular agent: 15 g evaporated and recovered water: 25 ml |
| Rinsing 1 | 45.0 | 5 | — |
| Rinsing 2 | 45.0 | 3 | — |
| Rinsing 3 | 45.0 | 3 | — |
| Rinsing 4 | 45.0 | 5 | 175 ml |
| Drying | 80 | | |

(Note)
* Replenishing amount per $m^2$ of the light-sensitive material.
** Rinsing was in a 4-tank countercurrent system from (1) to (4).

Each processing solution had the following composition.

| [Color Developer] | [Tank Solution] | [Replenisher] |
|---|---|---|
| Water | 800 ml | 800 ml |
| Fluorescent brightening agent (FL-1) | 4.0 g | 8.0 g |
| Residual color reducing agent (SR-1) | 3.0 g | 5.5 g |
| Sodium p-toluenesulfonate | 10.0 g | 10.0 g |
| Ethylenediaminetetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium N,N-bis(sulfonatoethyl) hydroxylamine | 8.5 g | 14.0 g |
| 4-Amino-3-methyl-N-ethyl-N-(β-methanesulfonamidoethyl)-aniline 3/2-sulfate monohydrate | 7.0 g | 16.0 g |
| Potassium carbonate | 26.3 g | 26.3 g |
| Water to make | 1,000 ml | 1,000 ml |
| pH (at 25° C., adjusted by sulfuric acid and KOH) | 10.25 | 12.6 |

| [Bleach-Fixing Solution] | [Tank Solution] |
|---|---|
| Water | 800 ml |
| Fixing agent (see Table 2-2) | 0.5 mol |
| Succinic acid | 29.5 g |
| Ammonium iron (III) ethylenediaminetetraacetate | 47.0 g |
| Ethylenediaminetetraacetic acid | 1.4 g |
| Nitric acid (67%) | 17.5 g |
| Imidazole | 14.6 g |
| Ammonium sulfite | 16.0 g |
| Potassium metabisulfite | 23.1 g |
| Water to make | 1,000 ml |
| pH (at 25° C., adjusted by nitric acid and aqueous ammonia) | 6.00 |

| [Rinsing Solution] | [Tank Solution] | [Replenisher] |
|---|---|---|
| Chlorinated sodium isocyanurate | 0.02 g | 0.02 g |
| Deionized water (electrical conductivity: 5 μS/cm or less) | 1,000 ml | 1,000 ml |
| pH (at 25° C.) | 6.5 | 6.5 |

FL-1:

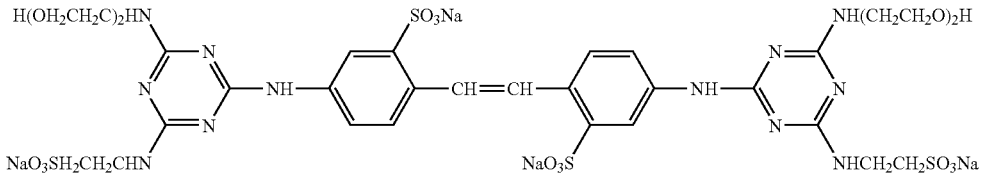

SR-1:

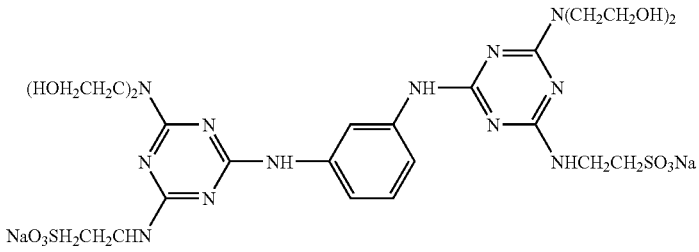

TABLE 2-1

Regeneration Ratio of Bleach-Fixing and Composition of Regenerated Replenishing Agent (per liter of overflow solution of bleach-fixing solution)

| | | Regeneration Ratio | | | | |
|---|---|---|---|---|---|---|
| No. | Compound | 0% | 40% | 50% | 60% | 80% |
| A | dried-up product of overflow solution of bleach-fixing solution | none | 400 ml of dried-up product | 500 ml of dried-up product | 600 ml of dried-up product | 800 ml of dried-up product |
| B | fixing agent (see Table 2-2) | 1 mol | 0.8 mol | 0.75 mol | 0.7 mol | 0.6 mol |
| C | ammonium sulfite | 40 g | 32 g | 30 g | 28 g | 24 g |
| D | disodium ethylenediaminetetraacetate | 10 g | 8 g | 7.5 g | 7 g | 6 g |
| E | ammonium iron (III) ethylenediaminetetraacetate | 100 g | 80 g | 75 g | 70 g | 60 g |
| F | succinic acid | 15 g | 15 g | 15 g | 15 g | 15 g |

Incidentally, the regenerated granular replenishing agent was prepared as a core/shell multilayer granule by the method described in JP-A-2001-183780. A and B in the Table above were used as the core and C to F were multilayer-coated like layers to obtain a spherical granule having a diameter of about 3 mm.

The continuous processing was performed by changing the fixing agent of the bleach-fixing solution and the bleach-fixing replenisher as shown in Table 2-2 (Tables 2-2-1 to 2-2-3). After the completion of continuous processing, the following tests were performed and the results obtained are shown in Table 2-2.

<Evaluation Test>

Desilvering Property Test:

Coated Sample 001 exposed to give a maximum density was processed and the residual silver amount after processing was measured by fluorescent X-ray analysis.

Crystal Precipitation Test of Bleach-Fixing Solution:

The bleach-fixing solution was sampled from the processor and after the sampled solution was left standing at 10° C. for 2 days, the presence or absence of crystal precipitation was observed.

Image Preservability:

Unexposed coated Sample 001 was processed and after storing in an environment at 80° C./70% RH for 5 days, the increase of the yellow minimum density between before and after the storage was measured.

TABLE 2-2-1

Results of Desilvering Property Test (unit: g/m$^2$, area in the bold-line frame is the present invention)

| Fixing Agent | Regeneration ratio of bleach-fixing solution | 0% | 40% | 50% | 60% | 80% |
|---|---|---|---|---|---|---|
| | Amount of overflow solution of bleach-fixing solution | 35 ml/m$^2$ | 35 ml/m$^2$ | 35 ml/m$^2$ | 35 ml/m$^2$ | 35 ml/m$^2$ |
| | Amount of waste bleach-fixing solution | 35 ml/m$^2$ | 21 ml/m$^2$ | 17.5 ml/m$^2$ | 14 ml/m$^2$ | 7 ml/m$^2$ |
| Ammonium thiosulfate | | 0.33 | 0.36 | 3.88 | 9.22 | 20.4 |
| Ammonium thiosulfate: potassium thiocyanate = 1:1 | | 0.34 | 0.38 | 4.44 | 9.90 | 26.6 |
| 1a-1 | | 0.32 | 0.31 | 0.32 | 0.33 | 0.32 |
| 1a-2 | | 0.32 | 0.32 | 0.31 | 0.31 | 0.32 |
| 1a-4 | | 0.33 | 0.31 | 0.31 | 0.30 | 0.31 |
| 1a-6 | | 0.33 | 0.32 | 0.32 | 0.33 | 0.31 |

TABLE 2-2-2

Results of Crystal Precipitation Test
(O: no precipitation, X: precipitated, XX; precipitated in a large amount, area in the bold-line frame is the present invention)

| Fixing Agent | Regeneration ratio of bleach-fixing solution | 0% | 40% | 50% | 60% | 80% |
|---|---|---|---|---|---|---|
| | Amount of overflow solution of bleach-fixing solution | 35 ml/m$^2$ | 35 ml/m$^2$ | 35 ml/m$^2$ | 35 ml/m$^2$ | 35 ml/m$^2$ |
| | Amount of waste bleach-fixing solution | 35 ml/m$^2$ | 21 ml/m$^2$ | 17.5 ml/m$^2$ | 14 ml/m$^2$ | 7 ml/m$^2$ |
| Ammonium thiosulfate | | O | O | X | X | XX |
| Ammonium thiosulfate: potassium thiocyanate = 1:1 | | O | O | X | XX | XX |
| 1a-1 | | O | O | O | O | O |
| 1a-2 | | O | O | O | O | O |
| 1a-4 | | O | O | O | O | O |
| 1a-6 | | O | O | O | O | O |

TABLE 2-2-3

Results of Image Preservability Test
(yellow increased density on white base after storage at 80%/70% RH for 5 days, area in the bold-line frame is the present invention)

| Fixing Agent | Regeneration ratio of bleach-fixing solution | 0% | 40% | 50% | 60% | 80% |
|---|---|---|---|---|---|---|
| | Amount of overflow solution of bleach-fixing solution | 35 ml/m$^2$ | 35 ml/m$^2$ | 35 ml/m$^2$ | 35 ml/m$^2$ | 35 ml/m$^2$ |
| | Amount of waste bleach-fixing solution | 35 ml/m$^2$ | 21 ml/m$^2$ | 17.5 ml/m$^2$ | 14 ml/m$^2$ | 7 ml/m$^2$ |
| Ammonium thiosulfate | | 0.05 | 0.05 | 0.24 | 0.44 | 0.52 |
| Ammonium thiosulfate: potassium thiocyanate = 1:1 | | 0.05 | 0.06 | 0.34 | 0.49 | 0.58 |
| 1a-1 | | 0.05 | 0.05 | 0.05 | 0.05 | 0.05 |
| 1a-2 | | 0.05 | 0.05 | 0.05 | 0.05 | 0.05 |
| 1a-4 | | 0.05 | 0.05 | 0.05 | 0.05 | 0.05 |
| 1a-6 | | 0.05 | 0.05 | 0.05 | 0.05 | 0.05 |

It is seen from the results above that only in the case of using the compound of the present invention, even when 50% or more of the used bleach-fixing solution (overflow solution) was reused as the replenishing agent, the performances regarding the desilvering, crystal precipitation and image preservability were not deteriorated. According to the present invention, the waste bleach-fixing solution can be reduced without deteriorating the performances.

Example 2-2

A continuous processing (running test) was performed in the same manner as in Example 2-1.

The replenishment to the bleach-fixing bath was in a system of using a part of the overflow solutions of the bleach-fixing solution and the rinsing solution according to the following method. The continuous processing was performed by changing the regeneration ratio of the overflow solution. The composition of regenerated granular replenishing agent in each regeneration ratio is shown in Table 2-3.

<Procedure of Reuse>

1) A part of each overflow solution of the bleach-fixing solution and the rinsing solution was extracted.

2) By using an electrolytic silver recovery apparatus (BF-12, manufactured by Matsuda Kagaku K.K.), silver was recovered from the overflow solution to reduce the silver concentration in the overflow solution to about 1 g/liter.

3) The resulting overflow solution was concentrated and dried up by using a thin film-type flash evaporator (MF-10A, manufactured by Tokyo Rika K.K.) and the evaporated and recovered water was collected.

4) A regenerant was added to the dried-up product of the overflow solution to obtain a regenerated granular replenishing agent.

5) The regenerated granular replenishing agent for bleach-fixing and the evaporated and recovered water were separately replenished.

6) The evaporated and recovered water was replenished as the rinsing replenisher.

| Processing Step | Temperature (° C.) | Time (sec) | Replenishing Amount |
|---|---|---|---|
| Color development | 45.0 | 15 | 45 ml |
| Bleach-fixing | 40.0 | 15 | granular agent: 15 g evaporated and recovered water: 25 ml |
| Rinsing 1 | 45.0 | 5 | — |
| Rinsing 2 | 45.0 | 3 | — |
| Rinsing 3 | 45.0 | 3 | — |
| Rinsing 4 | 45.0 | 5 | 175 ml in total of evaporated and recovered water and rinsing replenisher |
| Drying | 80 | | |

(Note)

* Replenishing amount per m$^2$ of the light-sensitive material.

** Rinsing was in a 4-tank countercurrent system from (1) to (4).

Each processing solution had the following composition.

[Color Developer]

The tank solution and the replenisher both were the same as those in Example 2-1.

[Bleach-Fixing Solution]

The tank solution was the same as that in Example 2-1.

[Rinsing Solution]

The tank solution was the same as that in Example 2-1. As for the replenisher, the evaporated and recovered water from the overflow solution was used and the replenisher of Example 2-1 was used for the shortfall.

TABLE 2-3

Regeneration Ratio of Bleach-Fixing and Rinsing Solution, and Composition of Regenerated Replenishing Agent (per 6 liter of overflow solution of bleach-fixing solution and rinsing solution)

| No. | Compound | Regeneration Ratio 0% | 20% | 30% | 50% | 70% |
|---|---|---|---|---|---|---|
| A | dried-up product of overflow solution of bleach-fixing solution and rinsing solution | none | 1.2 liter of dried-up product | 1.8 liter of dried-up product | 3 liter of dried-up product | 4.2 liter of dried-up product |
| B | fixing agent (see Table 2-2) | 1 mol | 0.8 mol | 0.75 mol | 0.7 mol | 0.6 mol |
| C | ammonium sulfite | 40 g | 32 g | 30 g | 28 g | 24 g |
| D | disodium ethylenediaminetetraacetate | 10 g | 8 g | 7.5 g | 7 g | 6 g |
| E | ammonium iron (III) ethylenediaminetetraacetate | 100 g | 80 g | 75 g | 70 g | 60 g |
| F | succinic acid | 15 g | 15 g | 15 g | 15 g | 15 g |

Incidentally, the regenerated granular replenishing agent was prepared, similarly to Example 2-1, as a core/shell multilayer granule by the method described in JP-A-2001-183780. A and B in the Table above were used as the core and C to F were multilayer-coated like layers to obtain a spherical granule having a diameter of about 3 mm.

The continuous processing was performed by changing the fixing agent of the bleach-fixing solution and the bleach-fixing replenisher as shown in Table 2-4 (Tables 2-4-1 to 2-4-3). After the completion of continuous processing, a desilvering property test, a crystal precipitation test of bleach-fixing solution and an image preservability test were performed in the same manner as in Example 1 and the results obtained are shown in Table 2-4.

TABLE 2-4-1

Results of Desilvering Property Test (unit: g/m$^2$, area in the bold-line frame is the present invention)

| Fixing Agent | Regeneration ratio | 0% | 30% | 40% | 50% | 70% |
|---|---|---|---|---|---|---|
| | Amount of overflow solution | 210 ml/m$^2$ | 210 ml/m$^2$ | 210 ml/m$^2$ | 210 ml/m$^2$ | 210 ml/m$^2$ |
| | Amount of waste solution | 210 ml/m$^2$ | 147 ml/m$^2$ | 126 ml/m$^2$ | 105 ml/m$^2$ | 63 ml/m$^2$ |
| Ammonium thiosulfate | | 0.34 | 0.40 | 5.33 | 10.5 | 31.2 |
| Ammonium thiosulfate: potassium thiocyanate = 1:1 | | 0.34 | 0.49 | 6.77 | 11.6 | 33.7 |
| 1a-1 | | 0.33 | 0.33 | 0.33 | 0.32 | 0.33 |
| 1a-2 | | 0.32 | 0.33 | 0.32 | 0.32 | 0.32 |
| 1a-4 | | 0.34 | 0.34 | 0.31 | 0.32 | 0.33 |
| 1a-6 | | 0.34 | 0.33 | 0.31 | 0.32 | 0.33 |

TABLE 2-4-2

Results of Crystal Precipitation Test
(O: no precipitation, X: precipitated, XX; precipitated in a large amount, area in the bold-line frame is the present invention)

| Fixing Agent | Regeneration ratio | 0% | 40% | 50% | 60% | 80% |
|---|---|---|---|---|---|---|
| | Amount of overflow solution | 210 ml/m$^2$ | 210 ml/m$^2$ | 210 ml/m$^2$ | 210 ml/m$^2$ | 210 ml/m$^2$ |
| | Amount of waste solution | 210 ml/m$^2$ | 147 ml/m$^2$ | 126 ml/m$^2$ | 105 ml/m$^2$ | 63 ml/m$^2$ |
| Ammonium thiosulfate | | O | O | XX | XX | XX |
| Ammonium thiosulfate: potassium thiocyanate = 1:1 | | O | X | XX | XX | XX |
| 1a-1 | | O | O | O | O | O |
| 1a-2 | | O | O | O | O | O |
| 1a-4 | | O | O | O | O | O |
| 1a-6 | | O | O | O | O | O |

TABLE 2-4-3

Results of Image Preservability Test
(yellow increased density on white base after storage at 80%/70% RH for 5 days, area in the bold-line frame is the present invention)

| Fixing Agent | Regeneration ratio | 0% | 30% | 40% | 50% | 70% |
|---|---|---|---|---|---|---|
| | Amount of overflow solution | 210 ml/m$^2$ | 210 ml/m$^2$ | 210 ml/m$^2$ | 210 ml/m$^2$ | 210 ml/m$^2$ |
| | Amount of waste solution | 210 ml/m$^2$ | 147 ml/m$^2$ | 126 ml/m$^2$ | 105 ml/m$^2$ | 63 ml/m$^2$ |
| Ammonium thiosulfate | | 0.05 | 0.08 | 0.33 | 0.50 | 0.59 |
| Ammonium thiosulfate: potassium thiocyanate = 1:1 | | 0.05 | 0.10 | 0.39 | 0.55 | 0.60 |
| 1a-1 | | 0.05 | 0.05 | 0.05 | 0.05 | 0.05 |
| 1a-2 | | 0.05 | 0.05 | 0.05 | 0.05 | 0.05 |
| 1a-4 | | 0.05 | 0.05 | 0.05 | 0.05 | 0.05 |
| 1a-6 | | 0.05 | 0.05 | 0.05 | 0.05 | 0.05 |

It is seen from the results above that only in the case of using the compound of the present invention, even when 30% or more of the used bleach-fixing solution and rinsing solution (overflow solution) was reused as the bleach-fixing replenishing agent, the performances regarding the desilvering, crystal precipitation and image preservability were not deteriorated. According to the present invention, the waste solution of bleach-fixing solution and rinsing solution can be reduced without deteriorating the performances.

By the solid bleach-fixing composition of a silver halide color photographic light-sensitive material of the present invention comprising at least one compound represented by formula (I), a compact and stable bleach-fixing agent prevented from consolidation or deliquescence and also from generation of insoluble matters even when stored for a long period of time in a high-temperature high-humidity environment can be provided. When this composition is used, the amount of waste solution can be reduced and a color processing can be stably operated for a long period of time while maintaining the processing quality, so that this composition is particularly advantageous to the lab at the storefront.

The effect is outstanding particularly when the compound represented by formula (I) is a compound represented by formula (Ia).

According to the method for processing a silver halide color photographic light-sensitive material of the present invention comprising using at least one mesoion compound represented by formula (I), the used bleach-fixing solution or the used bleach-fixing solution and rinsing solution can be regenerated and used at a regeneration ratio as high as at least 50 mass % and moreover, adverse effects usually encountered in the regeneration use, such as desilvering failure, precipitation of crystal and worsening of image preservability, are reduced.

Accordingly, the amount of waste solution discharged along the photographic processing can be remarkably decreased.

This effect is particularly outstanding when the compound represented by formula (I) is a compound represented by formula (Ia).

The entire disclosure of each and every foreign patent application from which the benefit of foreign priority has been claimed in the present application is incorporated herein by reference, as if fully set forth.

What is claimed is:

1. A solid bleach-fixing composition for a silver halide color photographic light-sensitive material, comprising at least one compound represented by formula (Ia):

Formula (Ia):

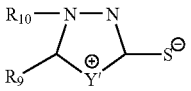

wherein Y' represents N—$R_6$ or $NNR_7R_8$; and $R_6$, $R_7$, $R_8$, $R_9$ and $R_{10}$ are the same or different and each represents a substituted or unsubstituted alkyl group having from 1 to 6 carbon atoms, provided that $R_7$, $R_8$ and $R_9$ each may be a hydrogen atom and that at least one of $R_6$, $R_7$, $R_8$, $R_9$ and $R_{10}$ is substituted by at least one carboxylic acid group or sulfonic acid group, and further comprising a silver complex salt of said at least one compound represented by formula (Ia).

2. The solid bleach-fixing composition for a silver halide color photographic light-sensitive material according to claim 1, which contains substantially no thiosulfate.

3. The solid bleach-fixing composition for a silver halide color photographic light-sensitive material according to claim 1, which is a granular bleach-fixing composition.

4. The solid bleach-fixing composition for a silver halide color photographic light-sensitive material according to claim 1, which is a tablet bleach-fixing composition.

* * * * *